US009706858B2

(12) United States Patent
Johnson et al.

(10) Patent No.: US 9,706,858 B2
(45) Date of Patent: Jul. 18, 2017

(54) ERGONOMIC BOTTLE DISPLAY

(71) Applicants: Terry J. Johnson, Chicago, IL (US); Travis Ogden Johnson, Chicago, IL (US)

(72) Inventors: Terry J. Johnson, Chicago, IL (US); Travis Ogden Johnson, Chicago, IL (US)

(73) Assignee: Gamon Plus, Inc., Bensonville, IL (US)

( * ) Notice: Subject to any disclaimer, the term of this patent is extended or adjusted under 35 U.S.C. 154(b) by 248 days.

(21) Appl. No.: 14/177,054

(22) Filed: Feb. 10, 2014

(65) Prior Publication Data

US 2014/0217041 A1 Aug. 7, 2014

Related U.S. Application Data

(63) Continuation-in-part of application No. PCT/US2012/050009, filed on Aug. 8, 2012.

(Continued)

(51) Int. Cl.

*A47F 1/04* (2006.01)
*A47B 73/00* (2006.01)

(Continued)

(52) U.S. Cl.

CPC ..... *A47F 1/04* (2013.01); *A47B 73/004* (2013.01); *A47F 7/285* (2013.01); *A47F 1/12* (2013.01)

(58) Field of Classification Search

CPC .... A47F 1/04; A47F 1/08; A47F 1/087; A47F 1/12; A47F 1/121; A47F 7/28; A47F 7/285; A47B 73/00; A47B 73/004; A47B 73/008

(Continued)

(56) References Cited

U.S. PATENT DOCUMENTS 2,311,449 A * 2/1943 Lilly ..... F25D 31/007 221/131
2,327,379 A * 8/1943 Thomas ..... A47F 7/285 211/59.3

(Continued)

FOREIGN PATENT DOCUMENTS

CA 2 844 666 A1 2/2013
FR 2 647 328 A1 11/1990

(Continued)

OTHER PUBLICATIONS

Espacenet.com: English language abstract of JP 2009119002(A) published Jun. 4, 2009.

(Continued)

*Primary Examiner* — Stanton L Krycinski
(74) *Attorney, Agent, or Firm* — Tiajoloff & Kelly LLP

(57) ABSTRACT

A product display displays bottles each suspended by its neck. The apparatus is usually a rack display with several shelf frames that each has a number of sliding bottle support structures with left and right slide structures spaced laterally so as to define a slot of substantially uniform width over at least a lengthwise portion of the slide structures. That width is such that the necks of the bottles extend upwardly through the slot and a widened portion of the bottle's neck rests on both the slide structures and slides forward and rearward. The left and right slide structures in the lengthwise portion are inclined forwardly and downwardly at a downward angle relative to level that is in a range of 3 to 7 degrees. Friction between the bottles and the slide structures is low enough that the bottles, by virtue of their weight, slide forwardly on the slide structures. A lower frame shelf provides a bumper rail that prevents the bottles in the shelf rack above from sliding off the front end of the slide structure. A bridging structure may link adjacent bottle support structures such that bottles are pushed to the rear of one support structure (Continued)

and then proceed slopingly downward on slide tracks in the bridging structure and the next adjacent bottle support structure.

28 Claims, 20 Drawing Sheets

Related U.S. Application Data

(60) Provisional application No. 61/521,565, filed on Aug. 9, 2011, provisional application No. 61/618,748, filed on Mar. 31, 2012.

(51) Int. Cl.
*A47F 7/28* (2006.01)
*A47F 1/12* (2006.01)

(58) Field of Classification Search
USPC ..... 211/59.2
See application file for complete search history.

(56) References Cited

U.S. PATENT DOCUMENTS 2,620,691 A * 12/1952 Gould ..... B67B 7/16 108/28
2,772,787 A * 12/1956 Lee ..... A47G 29/18 211/75
2,880,904 A * 4/1959 Linthicum ..... G07F 11/38 194/244
2,919,814 A * 1/1960 Berkowitz ..... A47F 7/281 211/74
2,943,900 A * 7/1960 Van Brunt ..... A47F 1/12 221/133
3,243,220 A * 3/1966 Karas ..... B65D 71/50 206/427
3,553,927 A * 1/1971 Anglade, Jr. ..... B65B 21/10 53/250
4,022,363 A * 5/1977 Eliassen ..... B65D 71/50 206/199
4,310,097 A 1/1982 Merl
4,318,485 A 3/1982 Clement
4,344,367 A 8/1982 Merl
4,367,818 A * 1/1983 Suttles ..... A47F 7/28 211/162
4,401,221 A * 8/1983 Suttles ..... A47F 7/285 211/59.2
5,586,665 A 12/1996 Brousseau
5,586,687 A * 12/1996 Spamer ..... A47F 7/285 193/32
5,595,310 A 1/1997 Spamer et al.
5,614,288 A * 3/1997 Bustos ..... A47F 1/12 211/59.2
5,669,527 A * 9/1997 Hardy ..... A47F 7/285 211/74
5,695,074 A 12/1997 Wiese
5,695,075 A * 12/1997 Flum ..... A47F 7/285 211/59.2
5,706,956 A * 1/1998 Headrick ..... A47F 7/285 211/59.2
5,706,957 A * 1/1998 Hardy ..... A47F 7/285 211/59.2
5,706,958 A 1/1998 Spamer
5,706,978 A 1/1998 Spamer et al.
5,718,341 A 2/1998 Robertson
5,755,341 A * 5/1998 Spamer ..... A47F 7/285 211/59.2
5,779,068 A * 7/1998 Whiten ..... A47B 43/006 108/107
5,788,091 A * 8/1998 Robertson ..... A47F 7/285 211/59.2
5,806,417 A * 9/1998 Whiten ..... A47B 57/404 108/106
5,865,326 A * 2/1999 Spamer ..... A47B 73/002 211/181.1
5,878,862 A * 3/1999 Dewsnap ..... A47F 7/285 193/27
5,878,894 A * 3/1999 Robertson ..... A47F 7/285 211/59.2
5,947,303 A * 9/1999 Robolin ..... A47F 7/285 211/59.2
6,059,125 A * 5/2000 Parham ..... A47B 73/00 211/162
6,189,734 B1 2/2001 Apps et al.
6,360,901 B1 3/2002 Parham
6,394,288 B1 * 5/2002 Hartwall ..... A47F 7/285 211/59.2
6,450,349 B2 * 9/2002 Lee ..... F25D 25/00 211/175
6,766,911 B2 * 7/2004 Higgins ..... A47F 7/285 211/59.2
7,802,697 B2 * 9/2010 Martin ..... A47B 73/004 221/165
2002/0166827 A1 11/2002 Robolin

FOREIGN PATENT DOCUMENTS

FR 2752709 A1 3/1998
JP 2002000416 A 1/2002
JP 2009119002 A 6/2009
WO 2013022980 A1 2/2013

OTHER PUBLICATIONS

Espacenet.com: English language abstract of FR2752709 (A1) published Mar. 6, 1998.
Espacenet.com: English language abstract of JP 2002000416 published Jan. 8, 2002.
Espacenet.com: English language abstract of FR2647328 A1 published Nov. 30, 1990.

* cited by examiner

ERGONOMIC BOTTLE DISPLAY

RELATED APPLICATIONS

This application is a continuation-in-part of International Application No. PCT/US2012/050009, filed Aug. 8, 2012 and published as WO 2013/022980 A1, herein incorporated by reference in its entirety, which asserts the priority of U.S. provisional application Ser. No. 61/521,565 filed Aug. 9, 2011 and U.S. provisional application Ser. No. 61/618,748 filed Mar. 31, 2012, both of which are also herein incorporated by reference in their entirety.

FIELD OF THE INVENTION

The present invention relates to product displays and dispensers and, more particularly, to gravity feed displays for bottles of liquid, such as beverages.

BACKGROUND OF THE INVENTION

Liquids, particularly beverages, are frequently sold in bottles of a plastic material or glass material. Where plastic material is used, commonly the bottle has a body configured to accommodate as much liquid as possible, and a neck extending upwardly therefrom that is sealed with a bottle cap. In plastic bottles particularly, the bottle neck is frequently provided with a flange that extends radially outward from the cylindrical bottle neck a short distance, and is located just below the lower end of the bottle cap when screwed on top of the bottle.

Numerous display racks exist for supporting bottles of this type for retail display. Use of shelves is undesirable, because the bottles are pushed to the back easily, and have to be brought forward manually for consumers to access them.

To overcome this, displays, such as the system shown in U.S. Pat. No. 5,586,665, support bottles suspended on racks that are tilted so that the bottles slide toward the front of the display. These systems, however, usually involve a complex structure to prevent the bottles sliding forward altogether off the front end of the rack that makes loading of the bottles difficult or increases the cost of the display unnecessarily.

It is also a drawback that most bottle display racks are accessed by customers by removing therefrom the most recently loaded bottle. As a result, some older product may remain at the rear of the rack for a fairly long time, with the newer bottles being loaded and removed in front of it. This results in retention of the older bottles in the rack longer than is desirable.

SUMMARY OF THE INVENTION

It is accordingly an object of the invention to provide a display apparatus that overcomes some or all of the deficiencies of the prior art.

A product display apparatus according to an aspect of the invention, displays a plurality of bottles each having a respective neck with a first width at a first height of the bottle and a wider portion thereabove. The apparatus comprises a sliding bottle support structure including left and right slide structures spaced laterally so as to define a slot of substantially uniform width over at least a lengthwise portion of the slide structures. The uniform width is such that the necks of the bottles extend upwardly through the slot and the widened portion rests slidingly on both the slide structures for forward and rearward sliding movement thereon. The left and right slide structures in the lengthwise portion are inclined forwardly and downwardly at a downward angle relative to level that is in a range of 3 to 7 degrees. The angle and the materials of the slide structures are such that friction between the bottles and the slide structures is low enough that the bottles by virtue of weight thereof slide forwardly on the slide structures.

According to another aspect of the invention, a display apparatus comprises a pair of vertical pillars each supporting a respective upper and lower frame structures. Each frame structure includes a pair of laterally spaced side arms each supported on a respective one of the pillars at a height selected from a plurality of vertical positions so that the upper frame is above the lower frame. Each frame farther comprises first and second cross members supported on and extending laterally between the side arms. A first inclined sliding support member is supported on the cross members and includes a pair of laterally-spaced upwardly-disposed inclined sliding tracks of high-impact polystyrene having about 10% silicone therein supported on the cross members and extending slopingly forward and downward at an incline angle of approximately 5 degrees and defining a slot therebetween. A plurality of bottles is supported on the sliding tracks, the bottles each having a neck portion extending through the slot and a neck flange wider than the slot resting slidingly on the tracks with friction between the flange and the sliding tracks being low enough that the weight of each of the bottles causes the bottle to move slidingly forward along the sliding tracks toward a forward terminal end thereof. The lower frame is at a height such that the first cross member thereof engages a lower portion of a forwardmost one of the bottles on the upper frame and prevents forward movement of the bottle to the forward terminal end of the sliding tracks thereof.

According to another aspect of the invention, a product display apparatus for displaying a plurality of bottles each having a respective neck with a first width at a first height of the bottle and a wider portion thereabove comprises a sliding bottle support structure including left and right slide structures spaced from each other so as to define a slot therebetween of substantially uniform width over a sliding bottle travel path of the bottle support structure formed by the slide structures. The uniform width is such that the bottles are slidingly supported with the necks of the bottles extending upwardly through the slot and the widened portion thereof resting slidingly on the slide structures. The bottle travel path includes a first substantially straight inclined portion wherein the slide structures extend linearly and slopingly rearwardly and upwardly at a first angle, a second substantially straight inclined portion wherein the slide structures extend linearly and slopingly rearwardly and upwardly at a second angle that is less steep than the first angle, and an intermediate curved portion connecting a rearward end of the first substantially straight portion and a rearward end of the second substantially straight portion such that the bottles may move slidingly on the slide structures rearward so as to travel through the first substantially straight portion, through the intermediate curved portion, and through the second substantially straight portion so as to be removed from a front end of the second substantially straight portion. The slide structures in the intermediate curved portion slope downwardly from the rearward end of the first substantially straight portion to the rearward end of the second substantially straight portion at a third angle. The first, second and third angles, and a level of friction between the bottles and the slide structures is such that bottles may be pushed slidingly rearward up the first substantially straight portion to an apex in the bottle travel path at a beginning of the intermediate curved portion, and, when pushed beyond said apex, said bottles slide by force of gravity through the intermediate curved portion and through the second substantially straight portion to the front end of the second substantially straight portion.

Other objects and advantages of the invention will become apparent from the specification herein.

DETAILED DESCRIPTION

Figure 1:
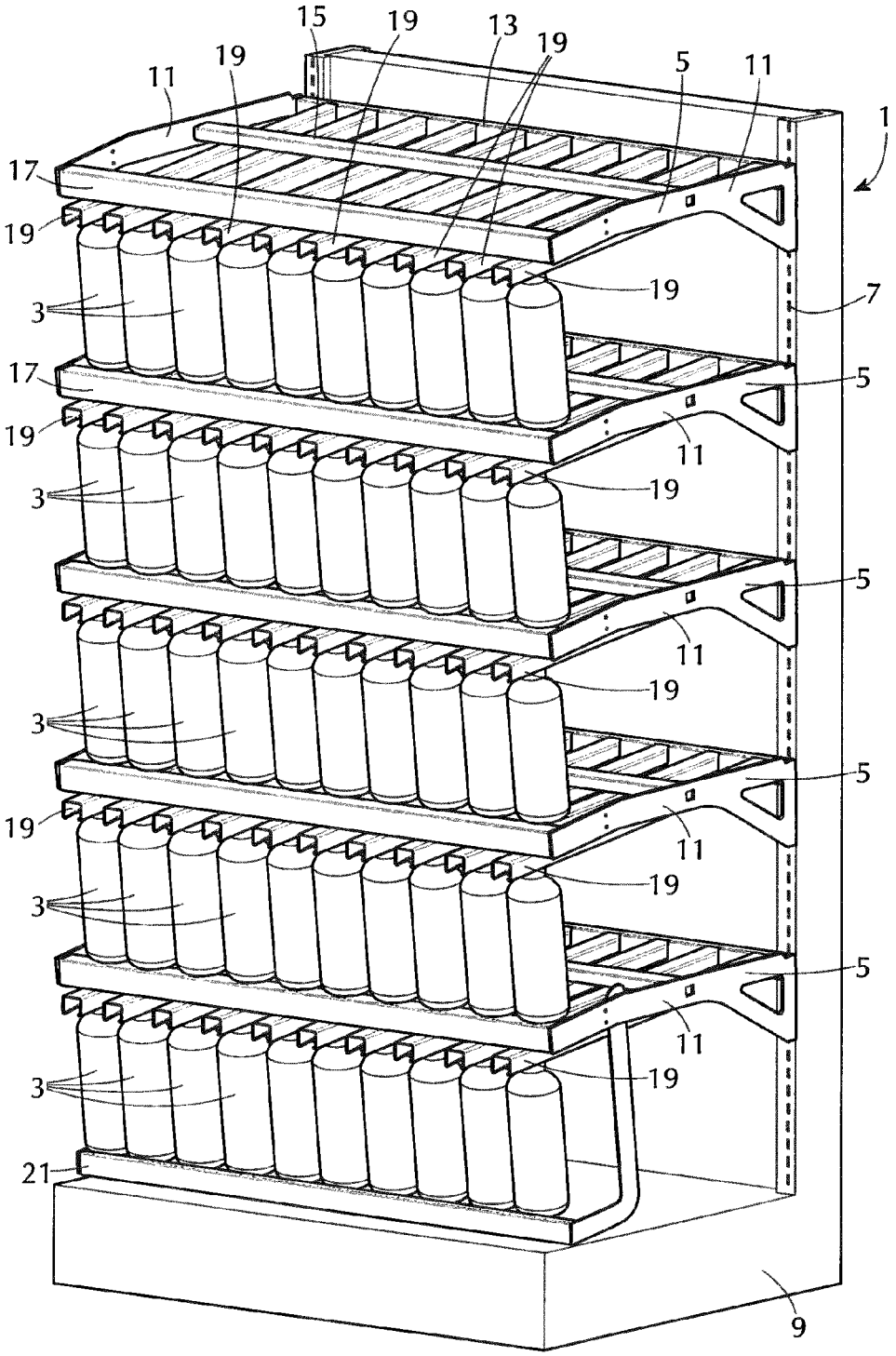
FIG. 1 is an isometric view illustrating one application of the display system of the present invention loaded with bottles.

As best seen in FIG. 1, a display rack 1 is provided to support a number of bottles 3, which are usually plastic bottles containing beverages or other liquid products for sale.

The bottles 3 are supported on a plurality of vertically-spaced frame structures 5 that are releasably secured at pre-selected heights by connection to side pillars 7 of the display rack, which are in turn rigidly connected to a base 9 that supports the display. Alternatively, the pillars 7 may be fixedly secured to a wall behind the display 1.

Figure 2:
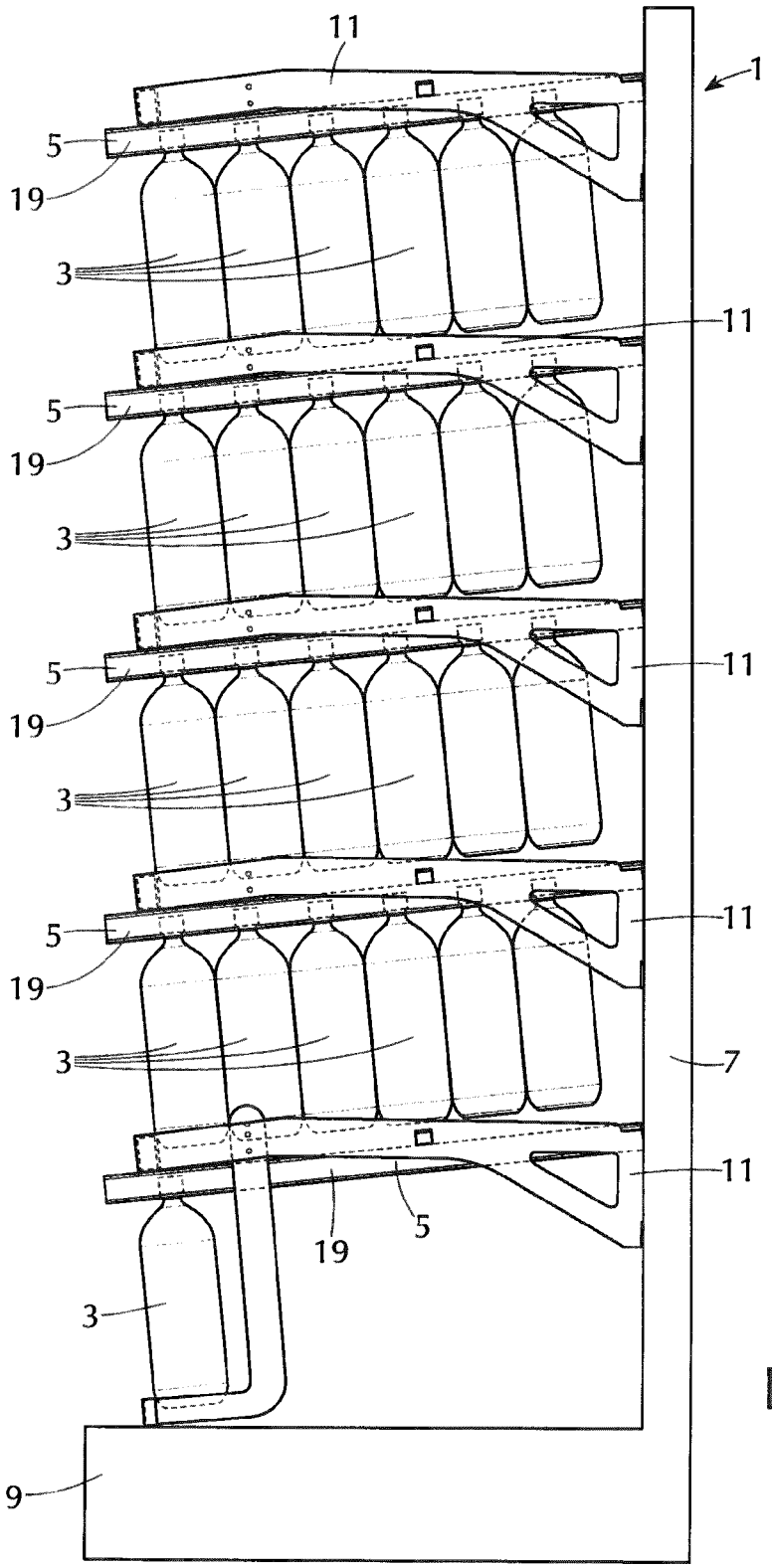
FIG. 2 is a side elevational view of the display of FIG. 1.

Referring to FIGS. 1 and 2, each of the frames is comprised of a pair of left and right side arms 11, each releasably secured to a pillar 7, pre-selected recesses in pillar 7 that set each frame at a height relative to the frame above and below so as to cooperate with them, as will be described in more detail below. Each frame 5 also comprises a rear cross beam 13, a middle cross beam 15, and a front cross beam 17 extending laterally across between the side arms 11. The frame also includes a plurality of sliding bottle support structures 19 that provide for support of the bottles 3 by the necks of the bottles so that the bottles can slide forward backward and forward with respect to the display 1. In the embodiment shown, the frames 5 which carry 10 substantially equally spaced sliding support structures or beams 19.

As best seen in FIGS. 3, 5, 6 and 7, sliding support structures 19 are essentially straight extruded members of constant cross-section that are inclined downwardly at a constant angle extending forward and downward relative to the display 1 to a terminal end at the front of the display 1. The bottles 3 are supported in the sliding support structures 19 so that the widened flange part of their necks rests on sliding tacks in the support structure 19 so that the bottles can slide forward and backward on it. In the embodiment shown the number of bottles on each sliding support structure 19 is six, but obviously a different number may be employed. The bottles can be loaded on the members 19 as deep as desired, the main consideration being the combined weight of the row of bottles and how difficult it is to push them back and load the rack.

The angle of the sliding support structures 19, and the structure and materials thereof are such that the bottles 3 supported by their necks, by virtue solely of the weight of the bottles, which overcomes the amount of friction involved, slide on the structure 19 forwardly toward its front terminal end, so that the bottles are biased by gravitational force to move toward the front of the display stand.

The bottles are prevented from sliding completely off the front ends of the support structures 19 by the fact that before the neck of the forwardmost bottle reaches the end of the support member 19, the lower end portion of the forwardmost bottle 3 on each support structure 19 encounters the front rail 17 of the frame 5 below the frame that supports the bottle 3. The lowermost rack 5 has no rack below it and is therefore provided with a front rail armature 21 that extends downwardly therefrom and across the display device 1 at a height such that it also engages the lower end of the forwardmost of the bottles 3 supported by that rack 5 so that it stops moving forward.

The forward terminal end of the support members 19 extends at a length beyond the stopping point at which the neck stops when the bottom of the bottle abuts the front rail 17. To remove the forwardmost bottle from the rack, a person tilts the bottle forward until the widened flange of the bottle neck reaches the terminal end 20 of the support member 19 and passes out of it. At the same time, the bottom of the bottle clears the top of the associated front rail 17, and the bottle is removed easily from the rack. The terminal end 20 extends forward of that point by a distance such that the bottle must be tilted forward to about 30 degrees from vertical before the neck leaves the member 19 and the bottom clears the front rail 17. Geometrically, it is best if the bottle clears the rail 17 before its neck ceases to be supported in the channel member 19, i.e., the terminal end 20 of the member 19 extends further forward than the location thereon supporting the bottle neck when the bottle bottom is high enough to pass over the rail 17.

Figure 3:
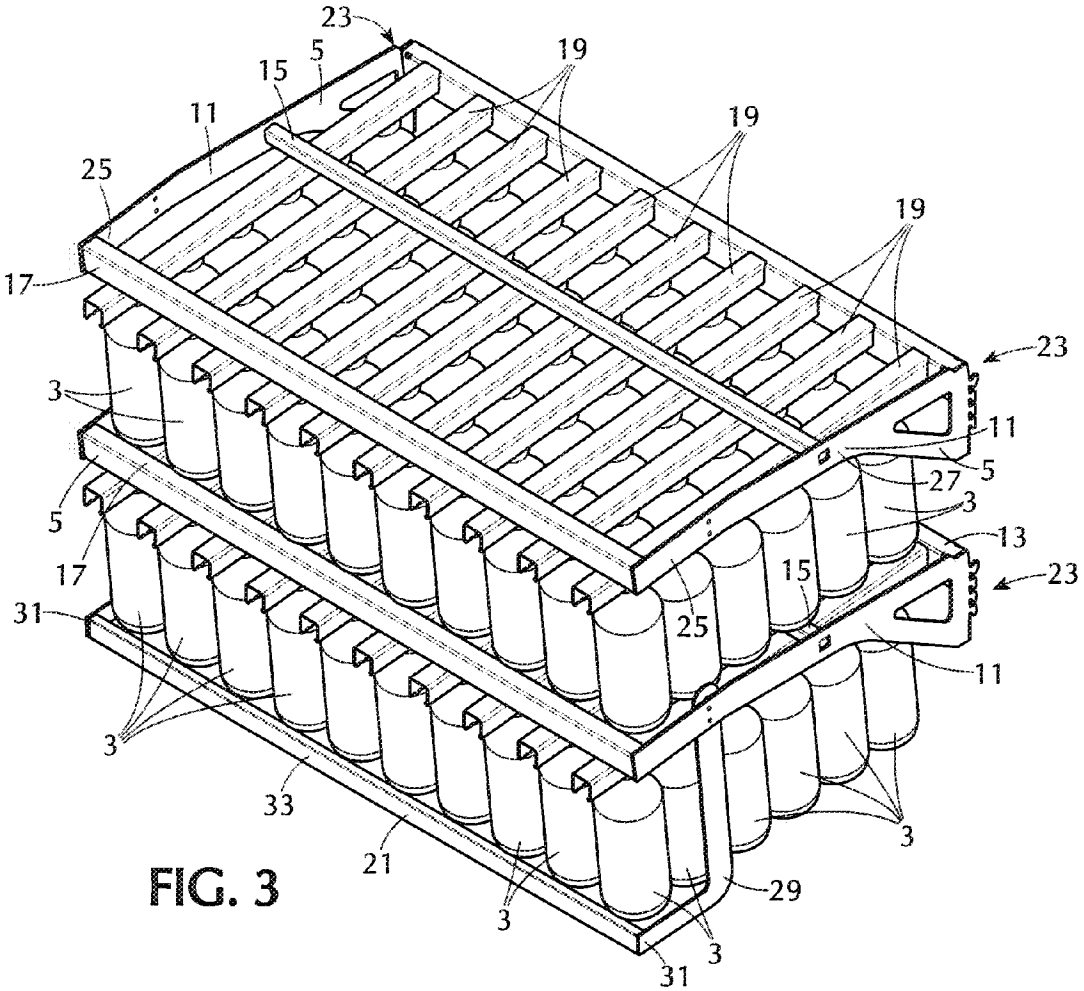
FIG. 3 is an isometric view showing the bottom two frame units shown without the support and supporting a plurality of bottles.
Figure 4:
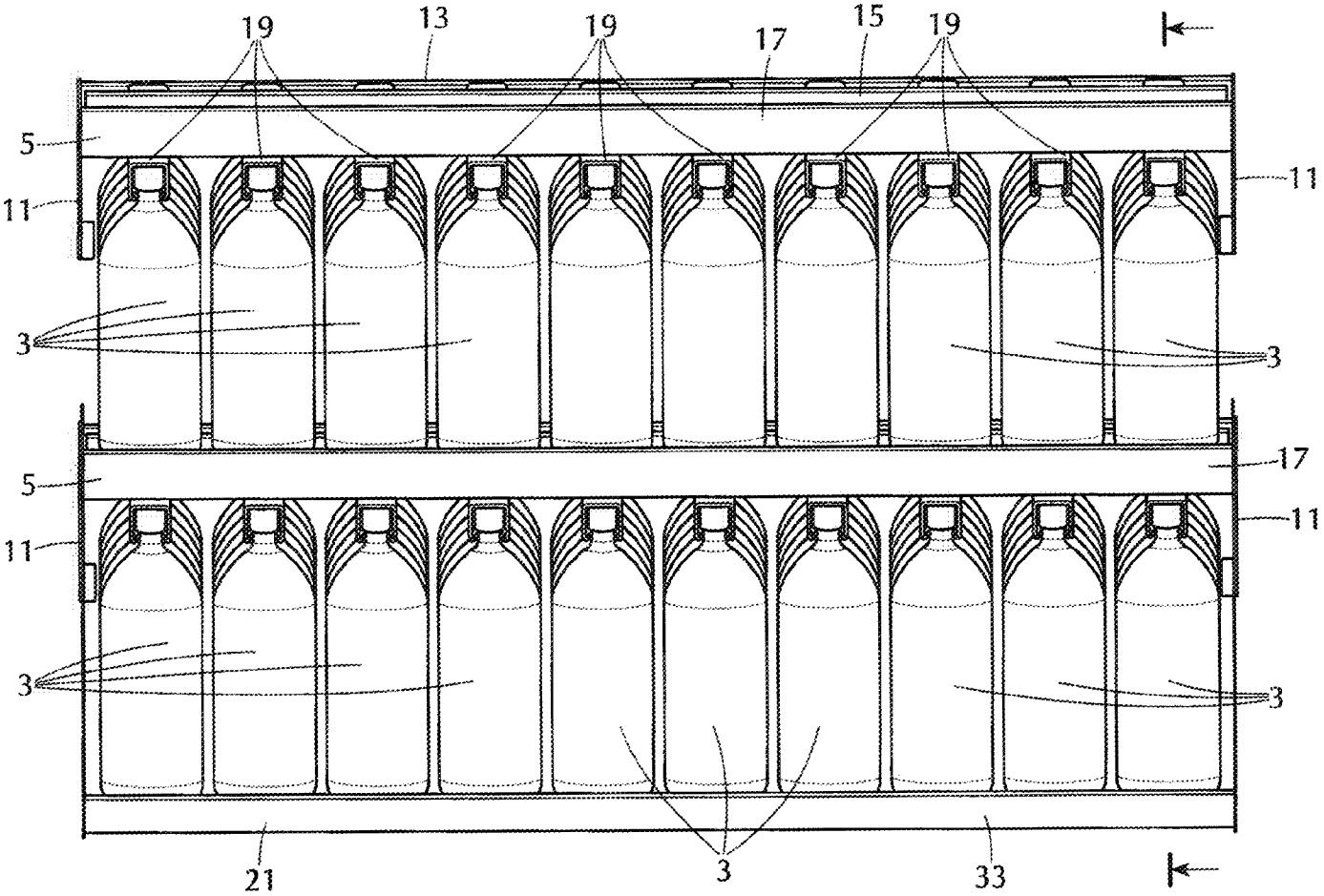
FIG. 4 is a front view of the two frames of FIG. 3.
Figure 6:
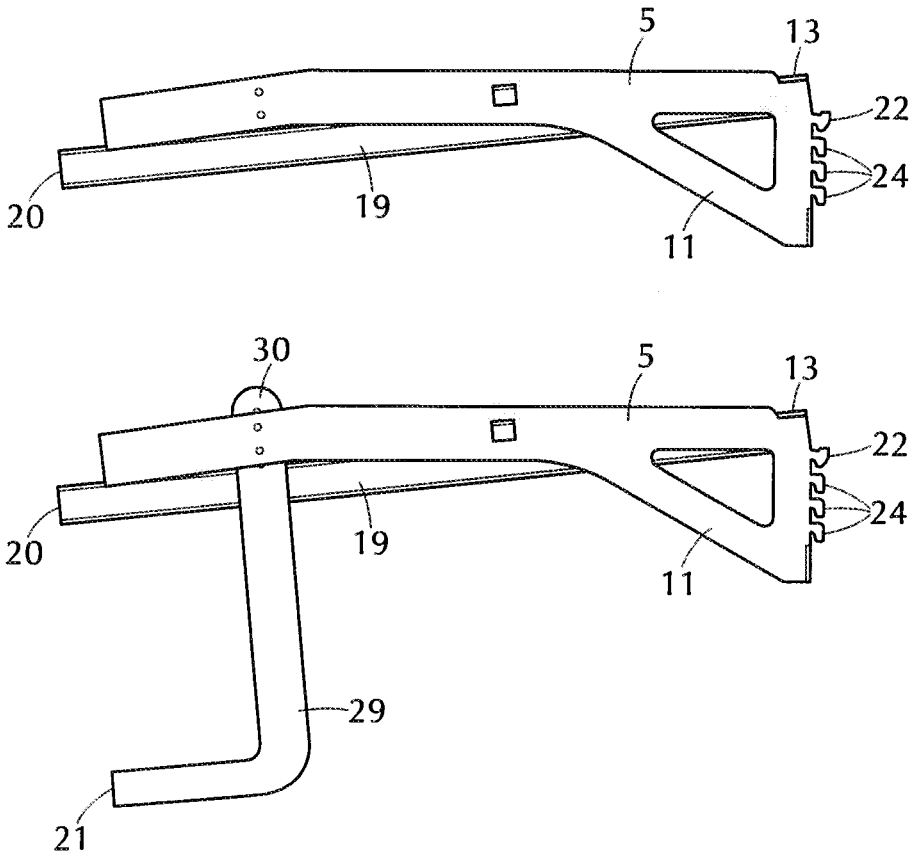
FIG. 6 is a side view of the frames of FIGS. 3, 4 and 5 with the bottles removed.
Figure 7:
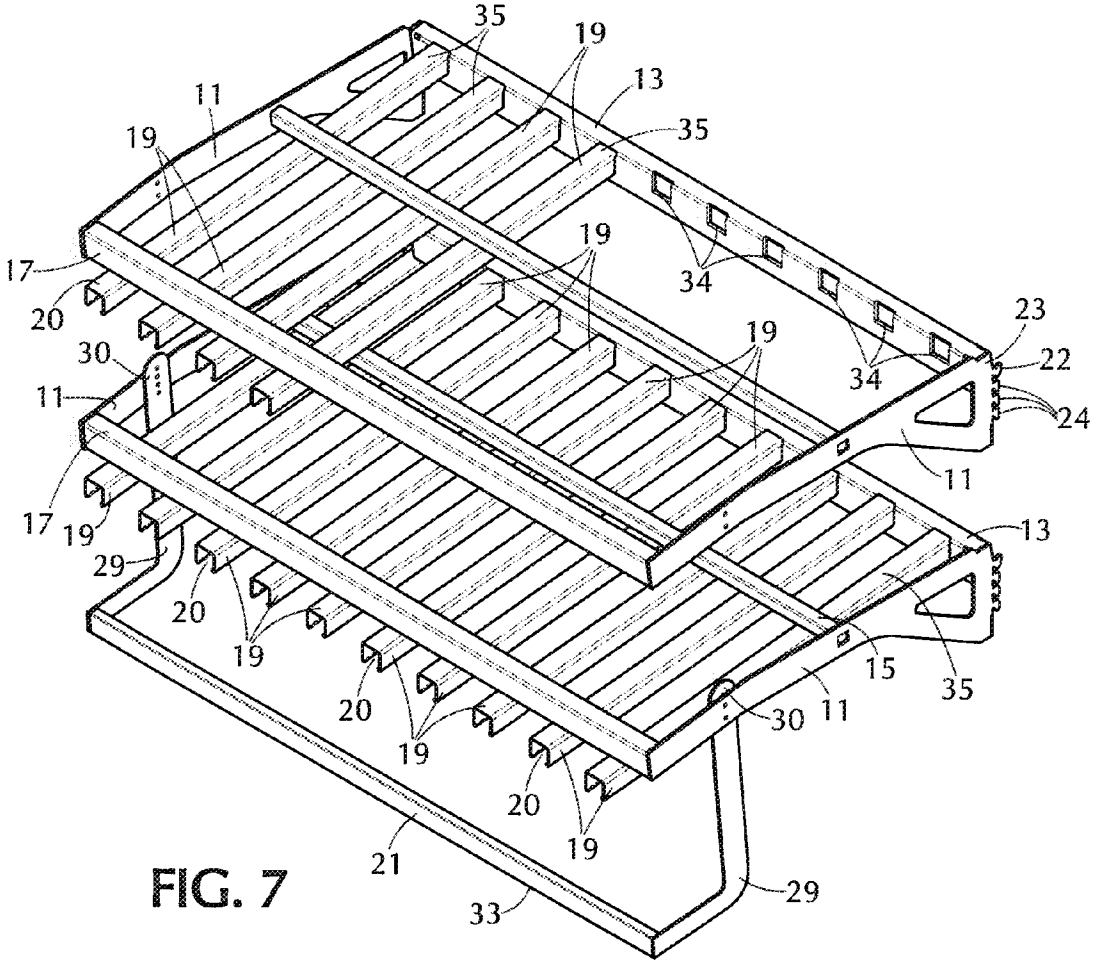
FIG. 7 is a view as in FIG. 3, with the bottles removed, and with a portion of the sliding supports removed to show the connection to the supporting frame structure.

FIG. 3 shows the two lower racks 5 of display 1 loaded with bottles 3 with the pillars 7 and surrounding structure removed to show parts of the apparatus. FIGS. 6 and 7 show the structure of FIG. 3 without the bottles to better illustrate the structure of the frames 5.

Referring to FIG. 7, the upper frame 5 has two parallel left and right side arms 11 which are formed of plate or sheet metal and project parallel forward from the rear of the rear thereof. The rear portion generally indicated at 23 of the arms is provided with an interlocking structure that detachably is inserted into a row of slots in the pillar 7, not shown.

The interlocking structure includes a series of hooks 24 of a standard configuration for insertion into a vertical slot row as in the standard pillar 7, which are all well known in the art. The top mounting hook 22 is configured with an upward protrusion that requires the side arm 11 to be tilted with its front end upwardly for insertion or removal of the arm 24 to or from the pillar.

Insertion of the arm 11 into the slots of pillar 7 is accomplished by tilting the front end upward, inserting the top protrusion of top hook 22 into the topmost slot to be connected, and then lowering the arm 11 to near level position in which all protrusions 22 and 24 can be and are inserted into the slots in pillar 7. The arm 11 is then pressed downward and the protrusions 22 and 24 all have downward disposed recesses that catch on the slots and hold the arm 11, and the attached frame 5, out in a cantilever fashion.

Tubular front rail 17 extends horizontally between the forward end terminal portions 25 of side arms 11, to which it is welded at both ends. Center cross arm 15 is attached fixedly to a connection structure generally indicated at 27 which secures the cross member 15 against upward and downward movement. The rear cross member 13 receives a connection structure as will be described herein and is fixedly secured by a pressure fit to extend perpendicularly between the rearward end portions 23 of the arms 11.

The front rail stop structure 21 for the lowermost frame 5 is shown in greater detail in FIGS. 6 and 7. The structure comprises an L-shaped member 29 having an upper end 30 connected releasably and adjustably to the inside wall of the side arm 11. The L-shaped member 29 extends generally vertically and perpendicularly to the side arm 11 downward and then generally horizontally forward of the display rack 1 to a terminal end 31 to which it is secured to the tubular cross member 33 that extends perpendicularly between the ends 31 of the side arms 11. This L-shaped structure 29 is adjustable vertically, so that it may be held at different pre-selected heights so that the crossbar 33 may be adjustably positioned in height to functions as a stop structure to abut the lower ends of bottles of differing sizes suspended from the sliding support member 19 of the lowermost frame 5.

Figure 5:
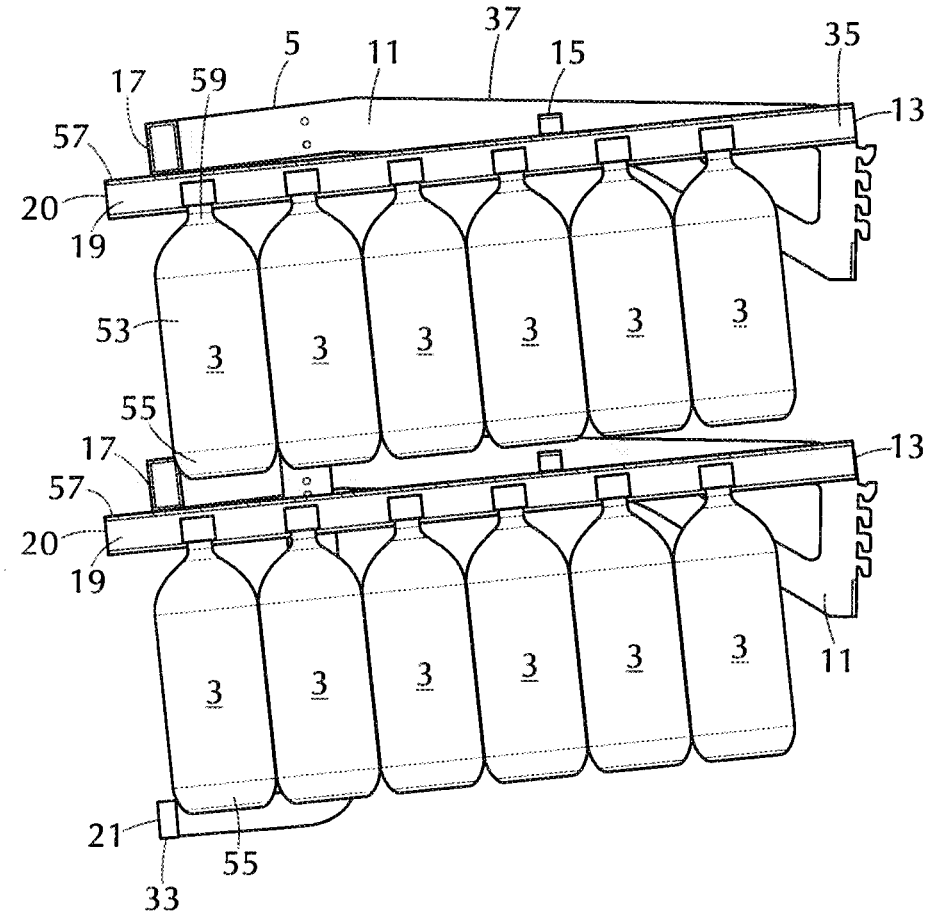
FIG. 5 is a view taken through plane A-A of FIG. 4.

Referring to FIG. 5, the side arms 11 support cross beams 13, 15 and 17, all of which are connected with the associated sliding support structure 19. This structure 19 is in the form of a channel shaped beam that extends straight from its rear terminal end to its forward terminal end 20. The rearward terminal end 35 is received in conforming openings 34 in cross member 13 as is best seen in FIG. 7, where a portion of the members 19 are removed. The openings 34 are configured to support the end of the beam 19 against downward or lateral movement relative to the rear cross beam 13.

The beam 19 is straight over its entire length and supported so that it extends forwardly and downwardly at an angle relative to the horizontal upper portion 37 of the side arm 11. The beam 19 is also secured by a screw or other fixed attachment mechanism to cross arm 15, which is a tubular beam, and also to the underside of cross member 17, which is also a tubular member. These beams 13, 15 and 17 are positioned to maintain the angle of the downward slope of the sliding support structure 19.

Figure 8:
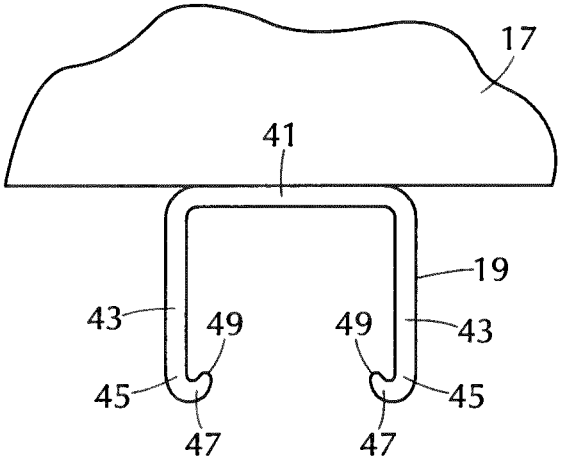
FIG. 8 is a detailed front end view from a forward end of a support member.

Referring to FIG. 8, the beam or sliding support structure 19 is secured to the box tubular cross beam 17, preferably by a bolt extending through an aperture in an upper wall of the beam and secured in the lower wall of tubular cross beam 17. The beam 19 itself is a linear extruded member of constant cross-section of polystyrene material that comprises a generally planar top wall 41 from which a pair of laterally-spaced vertical side walls 43 extend downwardly and integrally formed therewith. The side walls 43 have a lower terminal edge 45 that is formed integral with an inwardly extending flange or entrapping portions 47 that extend inwardly and upwardly so as to provide upwardly disposed surfaces 49 that act as a pair of sliding surfaces or rails on which the flared neck flanges of the bottles can hang and slide. Surfaces 49 are sliding surfaces and their frictional characteristics relative to the material and weight of the bottles are such that the bottles slide forward on the inclined beam 19 solely by virtue of their weight.

The material that the structure 19 is made of is high impact polystyrene. This high impact polystyrene (HIPS) is a material that includes from 5 to 11% silicone, and in the particularly preferred embodiment 10% silicone. Substantially greater than 11% silicone in the HIPS material results in a softer polystyrene beam that might have difficulty supporting the weight of a very large number of bottles suspended therefrom. On the other hand, reducing the amount of silicone substantially below 5% or even 7% silicone increases the friction on the surface of the polystyrene and may prevent the bottles from sliding forward.

Referring to FIG. 5, it may be seen that the beam 19 (and with it the sliding surfaces 49) is supported at a sloping angle that slopes downward and forward of the apparatus or the display apparatus. This downwardly sloping angle is in the embodiment shown is not greater than seven (7) degrees. Higher angles tend to create more downward force applied along the sliding path and make it more difficult to load bottles into the rack. The slope should also not be three degrees or less since the slope would be then insufficient to allow the weight of the bottle(s) to overcome the coefficient of friction between the bottle neck and the sliding surface 49 of the structure 19 and allow the bottle to slide forward. The preferred slope of this angle is five degrees downward which, combined with the material used for beam 19 and the other parameters, provides for biasing of the bottles 3 towards the front of the display solely based on their weight due to gravity and not due to any other apparatus or movement by an external force, e.g., by a user pulling the bottles forward. Generally, the slope of the sliding surfaces is as low as possible but steep enough that the friction between the bottle and the sliding surfaces of the beam is overcome by the force urging each bottle to slide down the sliding surfaces of the beam. It should also be understood that the angle of slope of the sliding surfaces of the beam 19 is measured when the bottles are not on the rack. When the bottles are loaded, it will produce a slight bend, which in the preferred embodiment is about ±1 degree.

As discussed previously, to prevent the bottles from sliding of the tracks 49 and out of the sliding support structure 19 altogether through the open front end of the beam 19, the lower portion 55 of the bottle encounters a rear portion of the front cross bar 17 of the lower frame 5 just below the frame from which the bottle 53 depends. This contact point is preferably close to the bottom so that it is relatively easy to withdraw the bottle from that position even for a person that is well below the level of the racks 5.

The front end 57 of the sliding support structures 19 extends substantially beyond the point at which the neck portion 59 of the forwardmost bottle 53 is in contact with the channel 19. The forward end 57 extends substantially beyond this point, and with all the angles requires that a person removing the bottle 53 from the rack 1 is required to tilt the neck 59 forward by about thirty degrees so that it can pass out of the space inside the channel 19 and passes over the stop structure 17. This dimensioning allows for a fairly short person to access a fairly high shelf or rack of bottles.

This interaction between the bottles of a first frame 5 and the cross beam 17 of the frame 5 just below it is not possible with the lowermost shelf 5. For the bottles in the lowermost shelf, the cross beam structure 21 is provided, which similarly abuts the lower ends 55 of the bottles or the forward most bottle in a way that allows for withdrawal of the bottle by tilting it forward at about thirty degrees so that the neck and the widened portion thereof can pass out through the open front end of extrusion beam 19. The positioning of the front beam 21 is such that the angle is the same for this frame 5 as well.

All of the bottles in the rack are removed by customers in this way. Similarly, the bottles are each loaded by tilting them forward about 30 degrees, passing the bottom of the bottle over the front beam 17, and then inserting the neck of the bottle into the beam 19.

Figure 9:
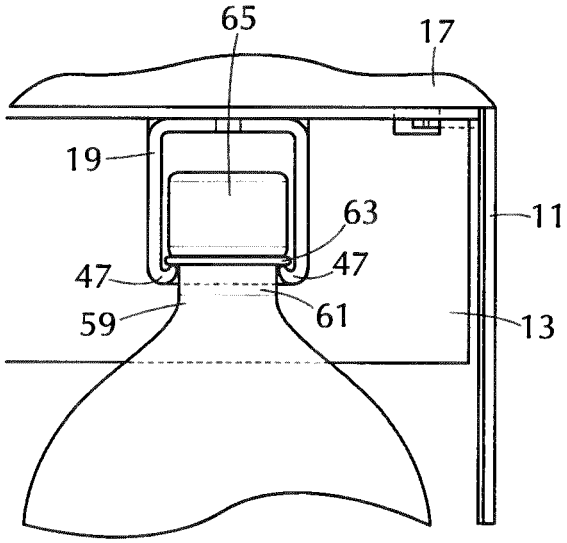
FIG. 9 is a detailed front end view of the sliding support member supporting a bottle.

Referring to FIG. 9, the details of the interaction between the bottle neck 59 and the channel shaped slide structure 19 are illustrated. The lower portions 47 of beam 19 define therebetween a recess that is wider than a central cylindrical section 61 of the upper part of the bottle. This part of the bottle extends through this recess between those parts. The bottle neck 59 further comprises a radially outwardly projecting flange 63 that projects horizontally outward around the entire circumference of the bottle neck 61. This flange 63 is usually the part of the bottle that rests on the sliding surfaces 49. The bottle is also provided with a cap 65 that is screwed onto the bottle so that usually the lower portion of the bottle cap 65 or the bottle cap structure (such as when there is a security lock on the bottle) engages the top surface of flange 63. The interior of beam 19 is large enough to receive the cap 65 and neck structure of the bottle even with tilting of the bottle for loading and unloading the rack.

Figure 12:
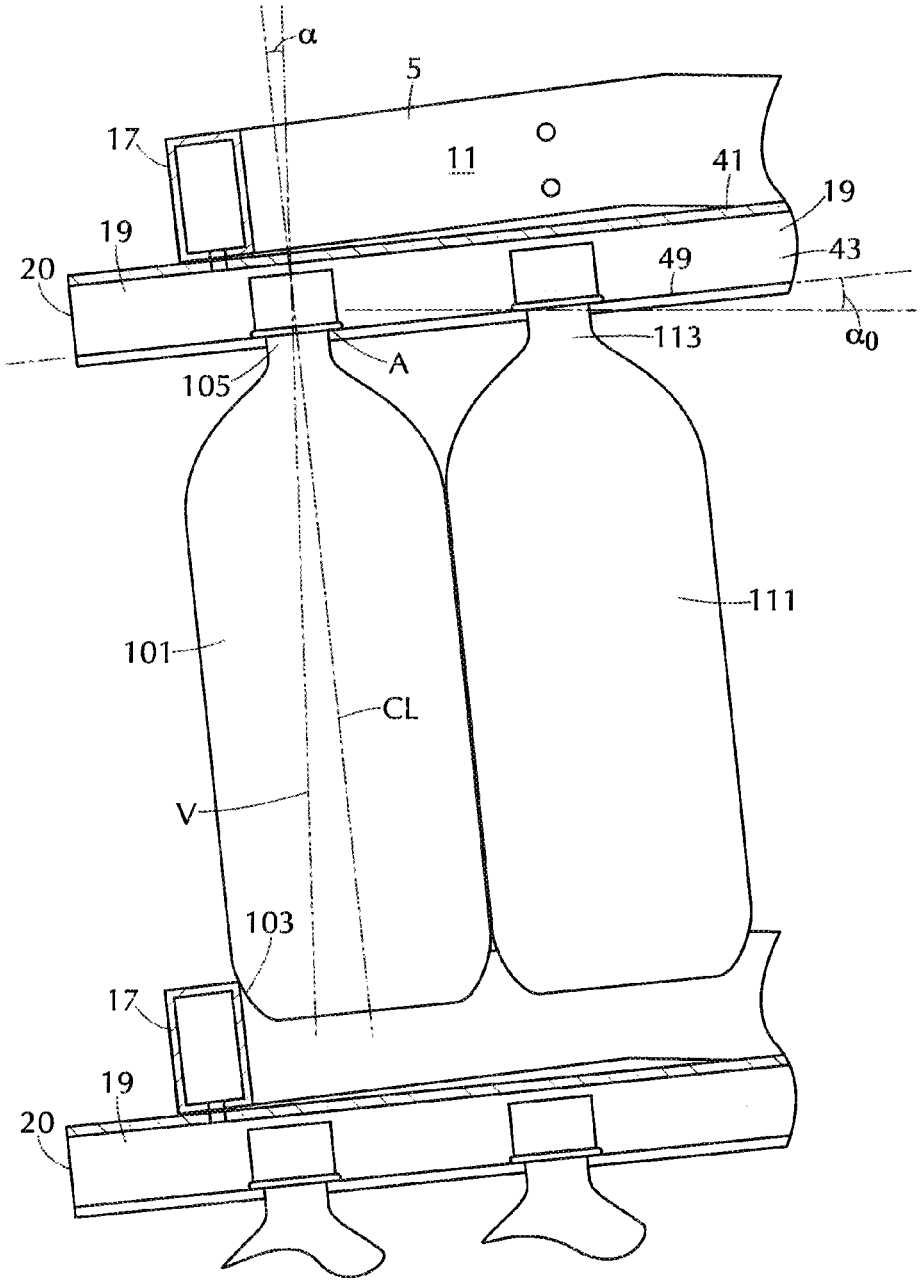
FIG. 12 is a detailed cross-sectional side view of the rack through one of the support members, showing the support of bottles on the rack of the preferred embodiment.

Referring to FIG. 12, the forwardmost bottle 101 slides forward along the inclined sliding support beam 19 urged solely by force of gravity, until its lower portion 103 contacts the cross beam 17, stopping its downward slide. The next bottle 111 behind bottle 101 also slides forward due solely to gravity, suspended by its neck 113 sliding along the sliding surfaces 49 of the beam 19. Bottle 111 slides forward until it pushes against bottle 101, which normally produces a slight tipping forward of bottle 101, with the neck 105 of bottle 101 reaching a stopping point A. This tipping forward is normally at an angle $\alpha$ relative to the vertical, illustrated by line V, that is approximately the same as the angle $\alpha_0$ of downward incline from horizontal. Other bottles, not shown, align in parallel resting against the next forward bottle, up to the full capacity of the beam 19 to support bottles.

Figure 13:
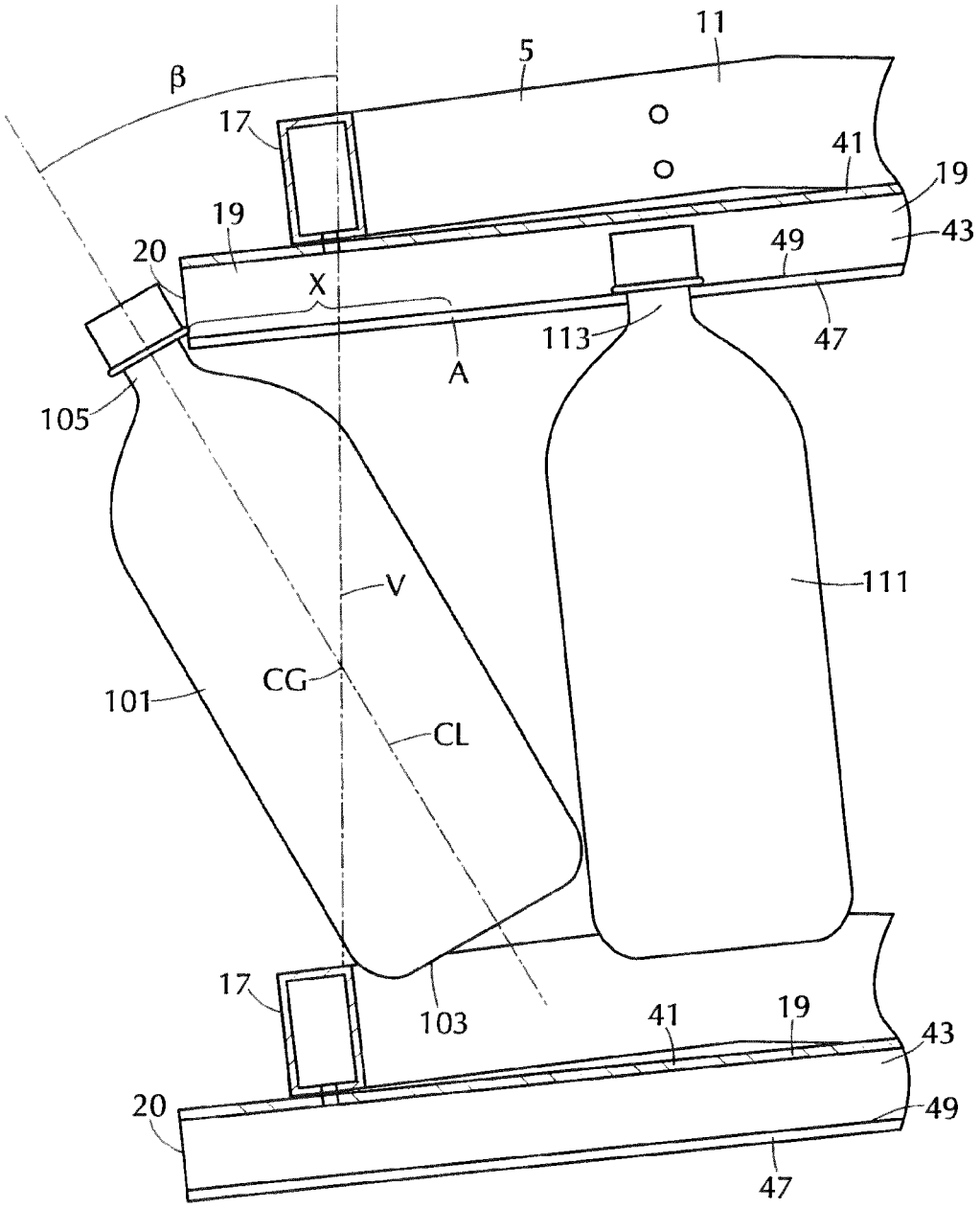
FIG. 13 is a view as in FIG. 12, showing the forwardmost bottle during loading into or removal from the display rack.

As best seen in FIG. 13, the forwardmost bottle 101 is removed from the rack by tilting the bottle 101 forward until the neck 105 passes out of the forward terminal end 20 of channel support beam 19. As the neck 105 clears the end 20, the lower end 103 continues to rest against cross beam 17, to some degree supporting weight of the bottle 101, which is at this point supported only by the hand of the customer or user and its engagement with cross beam 17.

The terminal end 20 is spaced from the stopping point A by a distance x that is such that the bottle 101 clears the end when tilted forward with its centerline CL at an angle $\beta$ of about 30 degrees from the vertical, shown as line V. At this angle $\beta$, the center of gravity CG of bottle 101 is above the cross beam 17, which results in weight of the bottle 101 resting on the beam 17. The customer or user then withdraws the bottle 101 forward, and it is lifted over or slides over the cross beam 17.

Placement of bottles into the rack is similar but in reverse. When a bottle is to be loaded in the rack, the bottle is tilted and inserted in the rack above the cross beam 17. The lower portion of the bottle 101 is pushed against the bottle 111 behind it, pushing bottle 111 upward along the sliding track 49 against the biasing of its weight to slide forward. When the neck 105 reaches the end 20 of the support member 19, the neck 105 is fit into the channel 19 so that the flange of the neck rests on and is slid backward until it reaches the stopping point A, to the positions shown in FIG. 12. Additional bottles may be loaded similarly, pushing the bottles rearward until the maximum number of bottles supportable on the given member 19 are loaded.

Figure 10:
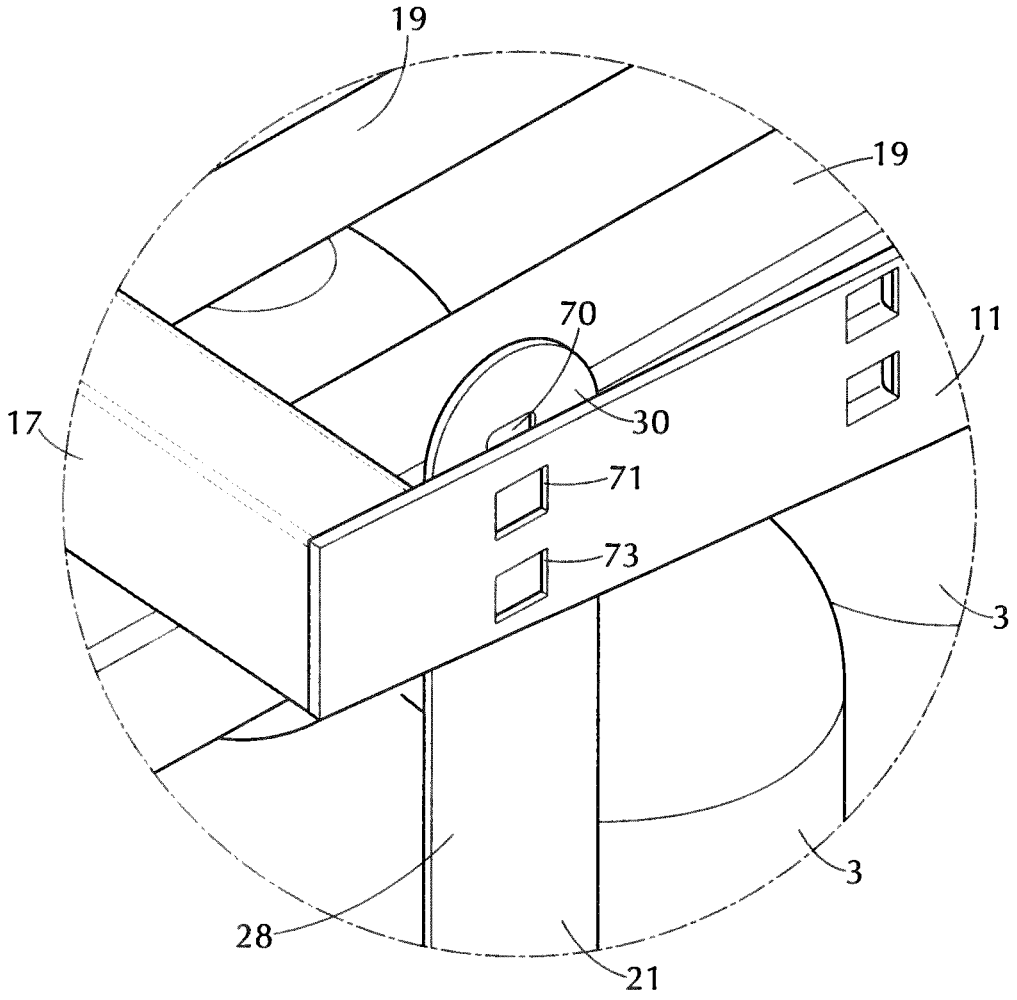
FIG. 10 is a detailed isometric view of a support of the adjustable stop structure of the lower frame.
Figure 16:
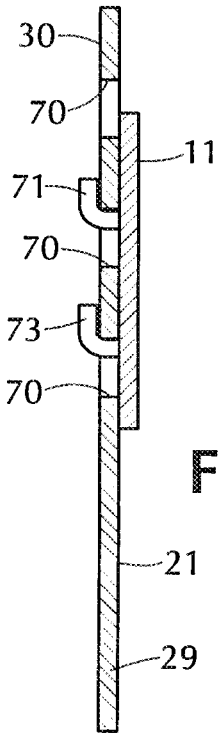
FIG. 16 is a reward looking vertical sectional view of the top of the adjustable support shown in FIG. 10.

FIGS. 10 and 16 show the connection of the adjustable side arm 21 to the side arm 11. This armature 29 has an upper end 30 that is supported laterally inward of the associated side arm 11, and has a plurality of apertures 70 therein that coactingly receive upwardly extending flat hook structures 71 and 73 as seen in FIG. 10. These hook structures 71 and 73 are able to receive the upper end of the structure 29 and fit securingly into a coacting structure on the device itself. Removal or adjustment of the L-shaped structure 29 is accomplished by simply lifting structure 29 and withdrawing it inward to clear the hooks 71 and 73, and then fitting different apertures 70 in the armature 29 onto the hooks 71, 73.

Figure 11:
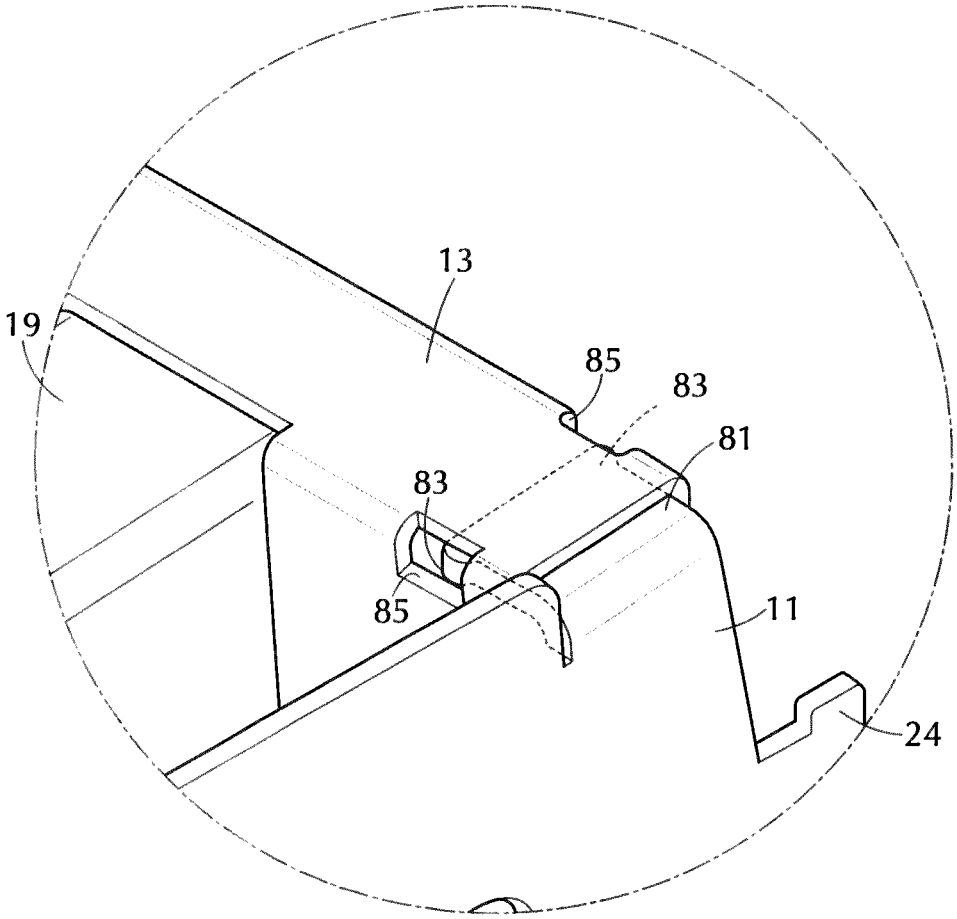
FIG. 11 is a detailed isometric view of a portion of the frame structure showing the connection between the side arm and the rear cross beam.
Figure 15:
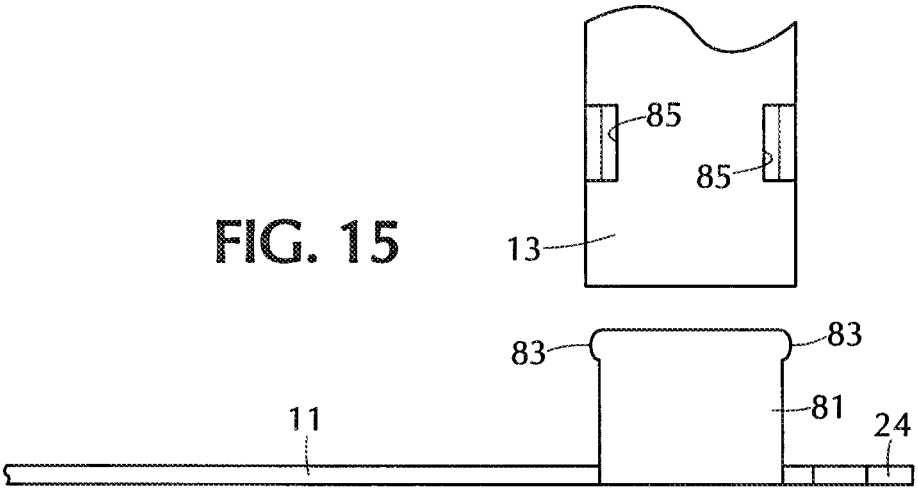
FIG. 15 is an exploded detail plan view of the corner structure shown in FIG. 11.

Referring to FIGS. 11 and 15, a pressure fit/clip structure secures the rear cross beam 13 to the side arm 11. The rear end of arm 11 has an inwardly extending flange 81 that extends into the interior of the generally U-shaped or channel-shaped structure of the rear crossbeam 13. When pressed into the cross beam 13, flange 81 has laterally extending protrusions 83 that snap into place in apertures 85 in the crossbeam 13, securing the cross beam 13 to the side arm 11.

The arrangement of the rack can be compressed somewhat vertically by eliminating the cross beam 15 on the lower racks. That is possible if the loads created by the bottles on the rack can be supported by the member 19 supported only by front rail 17 and rear rail 13. In that case, there is additional clearance of the bottles of the higher rack above the sliding member 19 of the rack below, allowing the side arms 11 to be vertically closer together.

Figure 14:
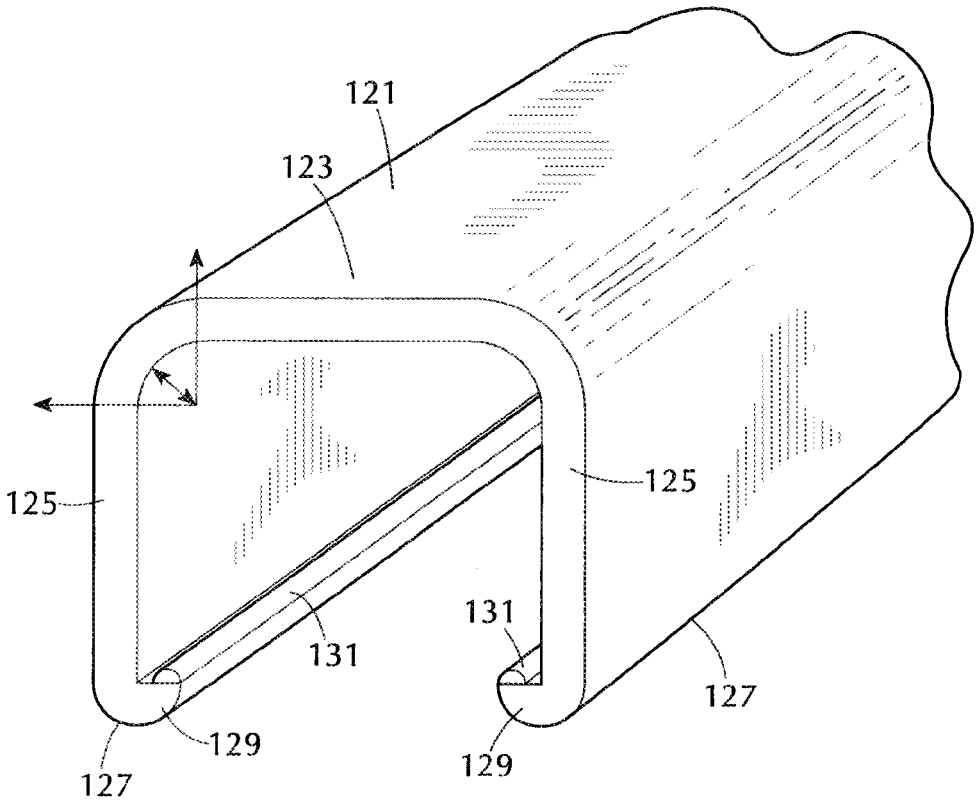
FIG. 14 is a perspective view of an alternate embodiment of support member.

FIG. 14 shows an alternate embodiment of sliding support structure 121. Support structure 121 is similar to the support structures 19 of the previous embodiment, in that it has an inverted generally channel shape with a top wall 123, and two laterally spaced downwardly depending side walls 125.

The side walls have straight lower edges 127 that each have an inwardly extending lip 129, that provides a small upwardly disposed surface extending the length of the support member 121. The space defined between the lips 129 is wide enough that the neck of a bottle can extend therethrough, but too narrow to permit exit of the bottle neck flange through the space, as in the previous embodiment.

The laterally inward edges of the upper surfaces of lips 129 are each provided with a respective linearly straight track of material 131 fused, glued, or fixedly secured by some other method, thereto. The support member 121 is supported as in the previous embodiment by structure that holds it cantilevered out at a downwardly and outwardly inclining angle. The neck flanges of the bottles rest on the tracks 131 and slide downwardly on the tracks 131 by gravity until the forwardmost bottle engages the front rail as described above.

These tracks 131 are of a material having a lower coefficient of friction than the material of which the rest of the support member 121 is composed. The tracks 131 of the support member 121 are of HIPS containing from 2% to 10% silicone, and most preferably 4% to 6% silicone, or about 5% silicone. The remainder of the support member 121 is of HIPS containing little or no silicone, which renders the material stronger. The slipperiness of the track material allows a relatively mild incline while the bottles will still slide down the support member on the tracks 131 to the front of the display, The slope of the incline may be less than 8 degrees, and is preferably from 5 to 6.5 degrees.

The strength of the channel member is enhanced by the walls 123 and 125 being of HIPS containing no silicone or very little silicone. The bending over its length when loaded with bottles is therefore reduced. Also, the channel is strengthened against the possibility of the bottles being somehow twisted so as to pry apart the lower lips 129 and tracks 131 by the use of the stronger HIPS material, and also by a rounding of the corners 133 between the top wall 123 and the side walls 125. The rounded corners have an inside radius of curvature of greater than 0.15, and preferably between 0.2 and 0.35 inches, and most preferably about 0.25 inches. This curvature strengthens the side walls 125 support against the spreading apart of the lips 129.

Figure 17:
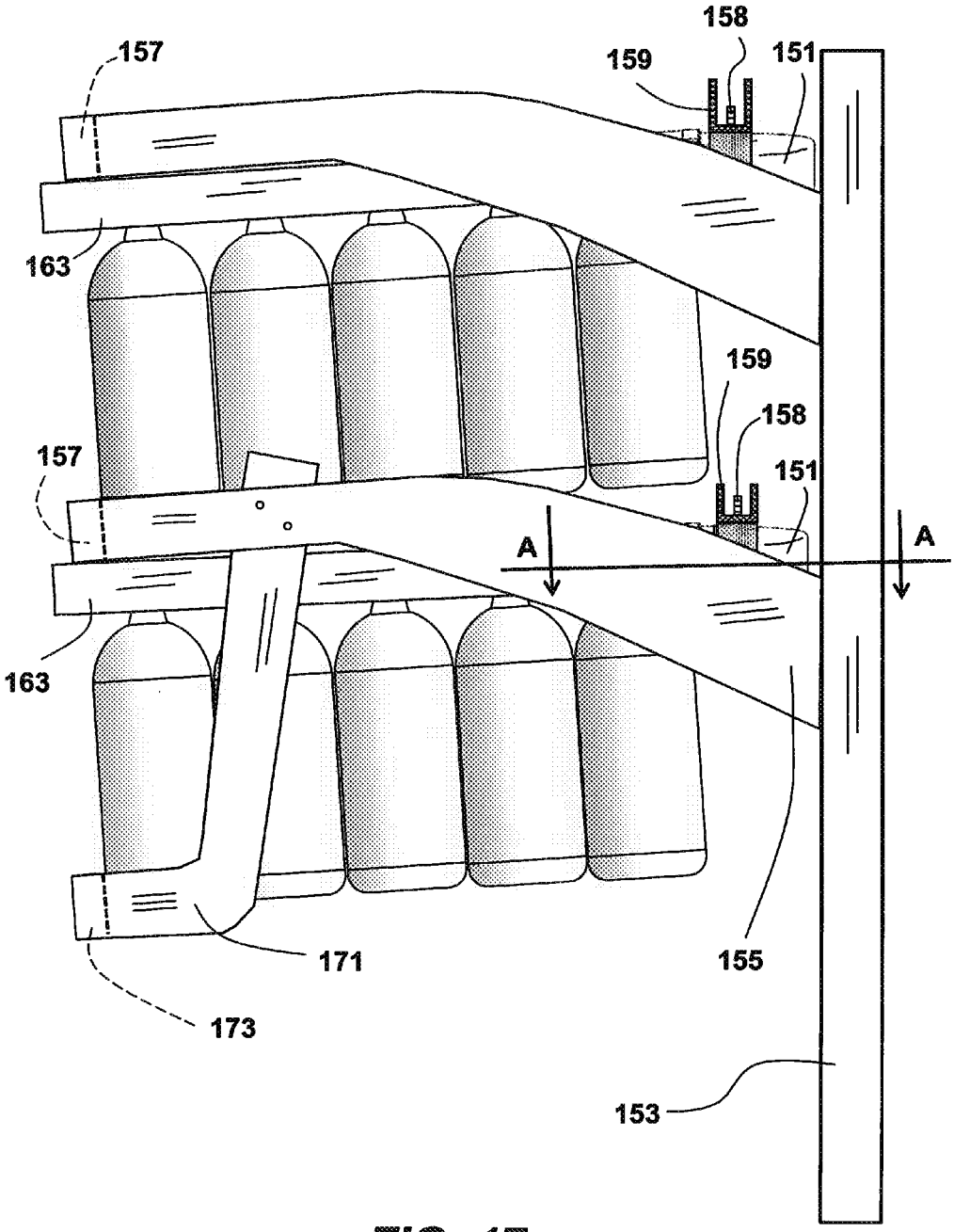
FIG. 17 is an side view of another embodiment of a display system of the present invention with a bridging support structure between adjacent channel members.

As best seen in FIG. 17, an alternate embodiment of a display system is provided that avoids a possible problem of older products being left at the rear of the display. This is accomplished using bridging support structures 151.

Figure 18:
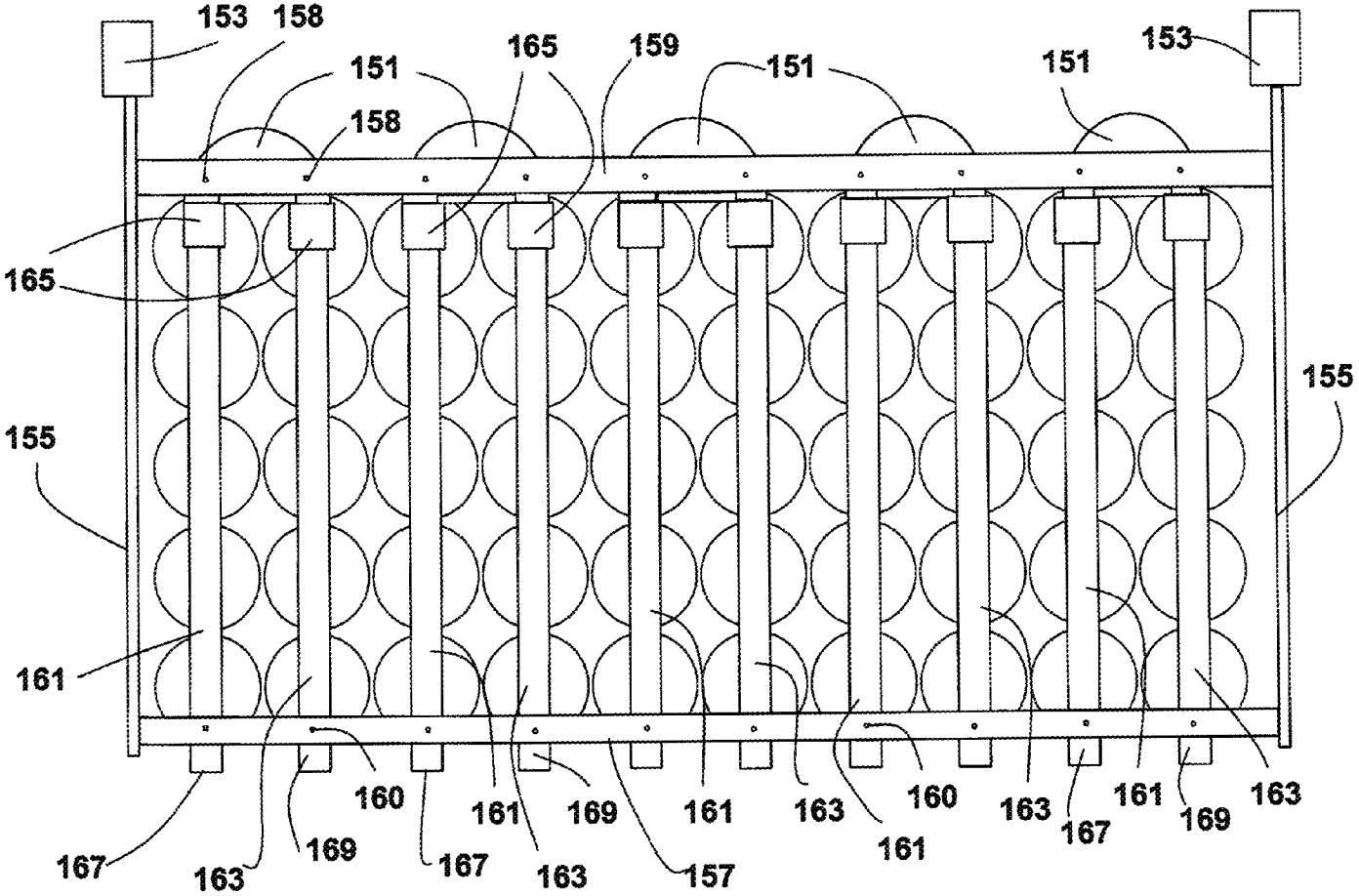
FIG. 18 is a top view of the display system as shown in FIG. 17
Figure 19:
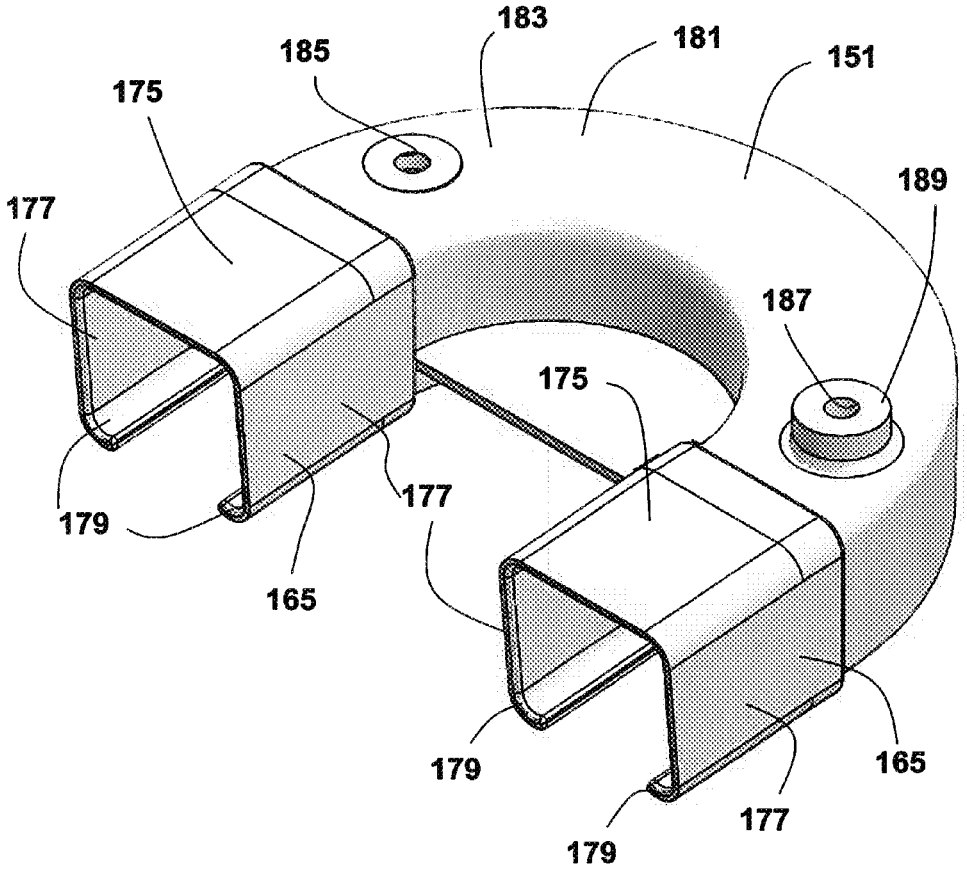
FIG. 19 is a perspective view of an embodiment of the bridging support structure of FIGS. 17 and 18.

As best seen in FIGS. 17 and 18, pillars 153 support thereon forwardly extending arms 155 Arms 155 are connected by cross beams 157 and 159 fixedly secured thereto. Bridging structures 151 are each secured by two self-tapping screws 158, bolts or other securement systems to rear cross member 159. Sliding support structures in the form of channel members 161 and 163 have forward ends connected by self-tapping screws 160, bolts or other securement systems to forward cross member 157. The rear ends of the channel members 161 and 163 are received supportingly in connective sleeve structures 165 of bridging support structures 151 at the rear of the display system.

Channel members or first and second sliding support structures 161 and 163 are configured similarly to the channel members of any of the previous embodiments. Each pair of channel members 161 and 163, together with the attached bridge unit 151 form a bottle travel path from a left hand-loading front portion 167 of member 161 through which bottles may be loaded and pushed rearward by a user so that they proceed to the bridging support structure 151, through which they proceed by sliding by force of gravity to the rear of the next adjacent channel member 163 to the right, and then slide forwardly down the right hand channel member 163 to a forward end 169 thereof for display and removal from the apparatus by customers. The point of connection between the sliding support structures 161 and the bridging support structures 151 defines an apex in the bottle travel path. The bottle travel path is straight to this apex, which allows bottles to be pushed rearward to that point. The bottles are pushed past the apex into the bridging support structure 151, where the sliding support structures start to curve to the right and also to slopingly descend, so that the bottles proceed beyond this apex point and through the second sliding support structure 163 solely under the force of gravity, i.e. without receiving any push by a user. First sliding support structures 161 have an incline angle upward and rearward that is greater than the downward incline angle of the second support structures 163. Bottles that do not reach the apex of the bottle travel path therefore slide forward and downward toward the front ends 167 of the first channel members 161. Bottles in the display therefore all move to the forward ends of channel members 161 and 163, as has been described in previous embodiments.

The bottles at the front ends 167 and 169 engage the front cross member 157 of the frame below it, as discussed above. The lowermost frame has an armature 171 that supports a lower cross beam 173 that abuts the lower ends of the forwardmost bottles in the lowest frame of sliding support structures 161 and 163. The operation of the display id essentially the same as in the previous embodiments. The main differences are the bridging units 151 at the rear, and the provision that loading of the display is preferably at the odd-numbered channel members 161, which rotates older stock to be pushed over the apex to return via channel member 163. The arrangement means that the incline angle of slope of channel members 161 is steeper, e.g., 5 to 7 degrees, most preferably about 7 degrees, as compared to the incline angle of the channel members 163, which is approximately 3 to 5 degrees, and most preferably about 5 degrees. The incline of the curved sliding tracks in the bridging structure 151, which will be described in eater detail below, is about 3 degrees, meaning that the rear end of the left channel member 161 is slightly higher than the rear end of the right channel member 163.

FIGS. 19 to 22 show the detailed embodiment of the bridging support structure 151. The bridging support structure 151 has sleeve structures 165 that are configured to entrappingly receive and support therein the rear ends of the channel sliding support structures 161 and 163. The connective sleeves are sized to fit snugly around a support structure, e.g. 161, and attach thereto. The sleeves fit around the outside of the channel members 161 and 163 with a top wall 175, two side walls 177 and a pair of lower lip flanges 179 that extend below the channel member 161 or 163, but define a space therebetween so as not to interfere with sliding of the bottles on the channel. The bridging support structure has end caps or sleeve structures 165 with the left one vertically higher than the other.

A generally arcuate housing 181 connects between the sleeve structures 165. The housing 181 includes an upper wall 183 with apertures 185 and 187 therein through which screws 158 extend to secure the bridging structure 151 to the underside of cross member 159. On aperture 185 is basically flush to the upper surface of the housing 181, while the other aperture 187 extends through a spacer structure 189 that ensures an angled slope of the housing and the sliding tracks therein. Gusset 184 reinforces the curved structure.

Figure 20:
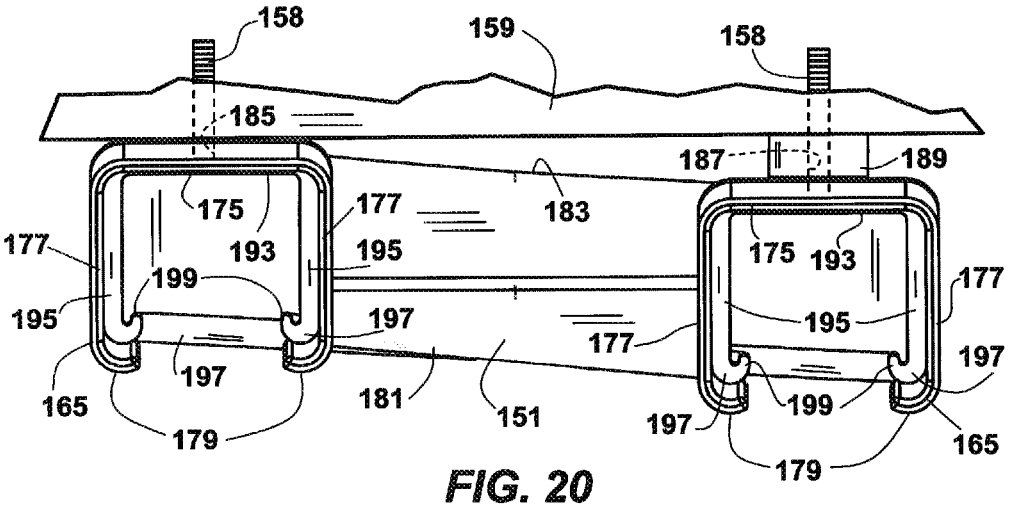
FIG. 20 is a front view of an embodiment of a bridging support structure of FIG. 19.
Figure 21:
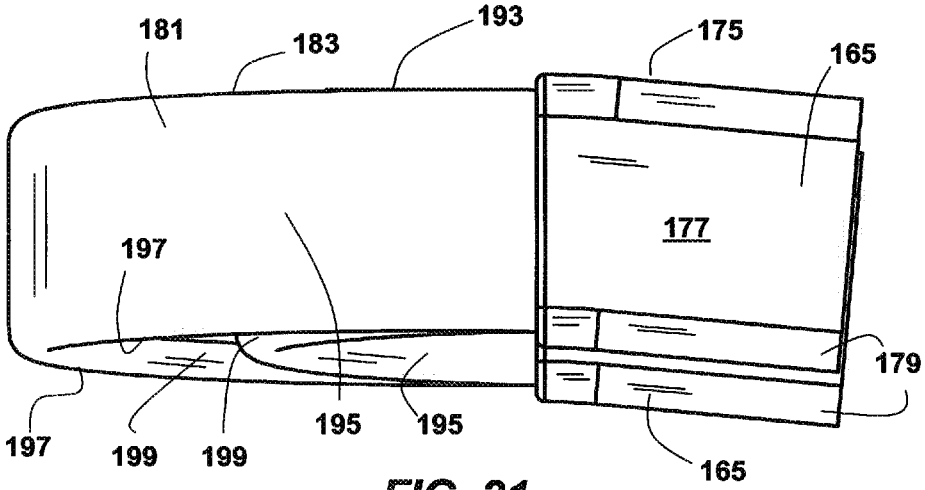
FIG. 21 is a left side view of the bridging support structure shown in FIG. 19.
Figure 22:
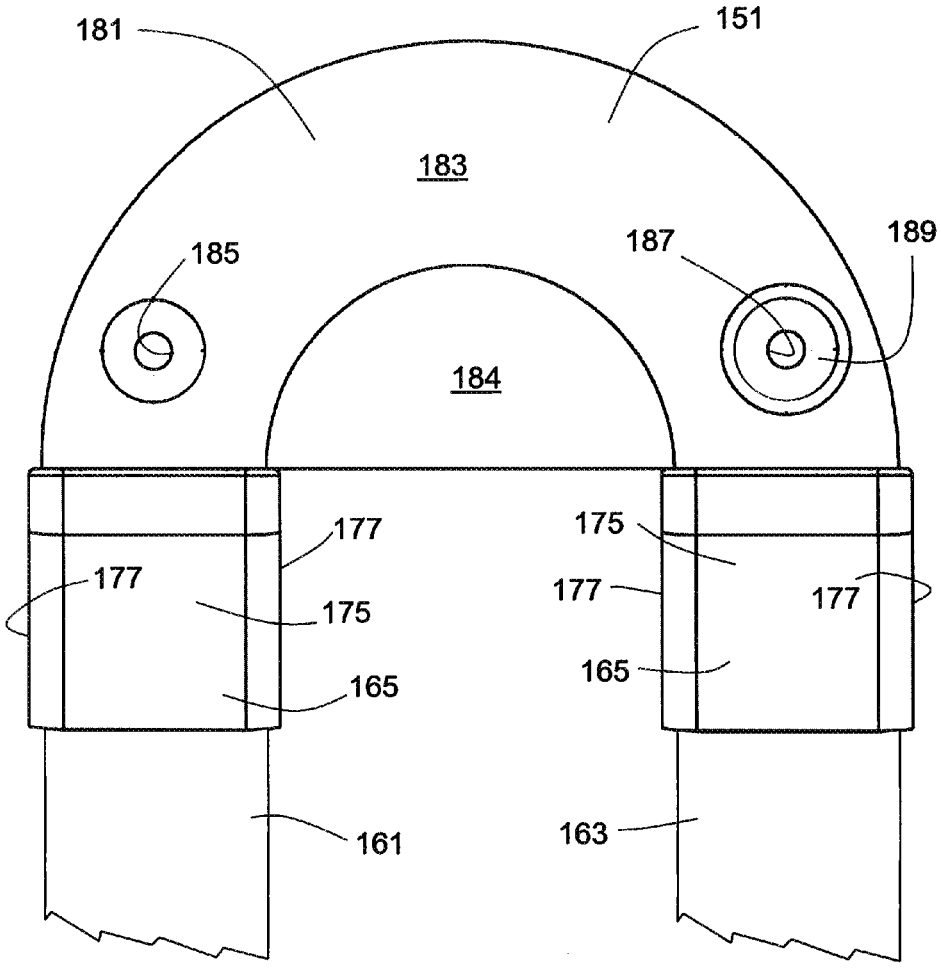
FIG. 22 is a top view of the bridging support structure shown in FIG. 19.

The internal structure of the bridging unit 151 is best seen in FIG. 20. Inside of the connective sleeve structures, the arcuate portion of the bridging structure unit 151 has a sliding support structure that is configured to match the cross section of the channel members 161 and 163 so as to allow sliding of the bottles therebetween without obstruction or blockage or friction. The interior of housing 181 has an inverted generally channel shape with a top wall 193, and two laterally spaced downwardly depending side walls 195. The side walls 195 have lower flanges 197 that each have an inwardly and upwardly extending lip 199 that provides an upwardly disposed sliding surface that supports the bottle necks sliding thereon. At least this contact portion of the bridging unit 151 is of HIPS with a silicone content of 5 to 13%, and most preferably 2 to 10%. The space defined between the lips 199 is wide enough that the neck of a bottle can extend therethrough, but too narrow to permit exit of the bottle neck flange through the space.

Figure 23:
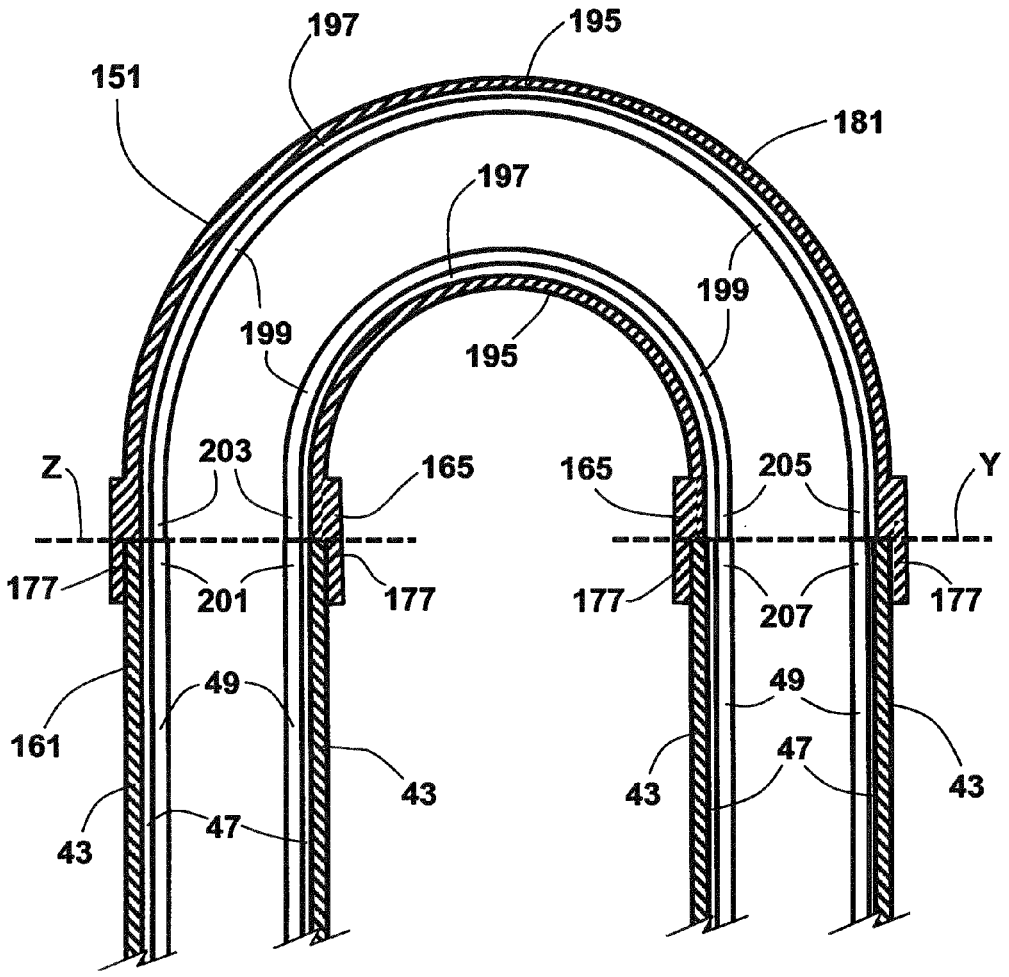
FIG. 23 is a downward sectional view taken through line A-A of FIG. 17.

The connection of the bridging support structure 151 to the two sliding support structures 161 and 163, and the resulting bottle travel path created by this combination of components is best seen in FIG. 23.

Channel members 161 and 163 have a cross section as seen in FIG. 8 or FIG. 14, and the same reference numbers are used herein to reference similar parts thereof such as support structures 121.

Channel member 161 extends straight rearward at an upward first angle of about 5 to 7 degrees, preferably 7 degrees. Bottles slide on sliding tracks 49 on lower flanges 47 of side walls 43 of the channel 161. At the rear end 201 of channel 161, sliding tracks 49 meets with the front portions 203 of sliding tracks 199 of the bridge unit 151. This meeting point is indicated at line Z in FIG. 23.

Up to this location or apex Z, the channel 161 and its sliding tracks extend slopingly upward and rearward at a constant angle of approximately 7 degrees. The front portions 203 are also straight as they meet the end portions 201 of the channel 161 tracks. However, the end portion tracks 199 immediately extend downwardly after the apex Z. The angulated difference between the upward slope of channel support 161 and the downward progression of the tracks 191 in the bridge structure thereafter result in the point indicated at Z being the highest point or apex of the bottle travel path.

At Z, the tracks 199 and 49 meet at the same height, although the difference in the angles of the sliding tracks 49 and 199 creates a slight bump or corner or angled ridge between the tracks 49 of channel 161, proceeding upward and rearward at an angle of about 7 degrees, and the tracks 199 of bridge unit 151, proceeding downward and rearward at an angle of about 3 degrees. Bottles are pushed rearwardly to this apex Z and over the ridge as a corner. After passing the apex Z, the bottle immediately slides by gravity down the sliding tracks 199, which extend slopingly downwardly from Z onward at the downward angle of approximately 3 degrees. The tracks 199 also start to curve at this point. The tracks 199 are at the same height taken at points of a radius through the centerpoint of the arcuate path of the bridging structure unit 151, or expressed another way, the tracks 199 descend in parallel spirals, so that the bottles hang vertically as they slide along the tracks 199.

The friction and angles of the bridging structure are such that bottles passing the apex Z slide downward purely by force of gravity around the arcuate portion 181 to the lower ends 205 of the curved tracks 199, which meet up with the rear ends 207 of the sliding tracks 49 on the flanges 47 on the side walls 43 of channel 163. At the point of meeting Y, the tracks 199 and the tracks 49 of channel support member 163 are at the same height to allow sliding movement of bottles between them, but there is a slight difference in angles, in that the tracks 199 descend at approximately 3 degrees coming to point Y, and the tracks 49 of member 163 extend slopingly forward and downward away from the meeting point Y at approximately 5 degrees. The result is a second slight downwardly angulated ridge of the 2 degrees steeper change in slope at Y. The ridge however is not an obstruction to the sliding travel of the bottles, and bottles slide over and past this second ridge easily by force of gravity, and also without human involvement, from the bridging structure 151 into the channel 163.

Channel 163 extends straight linearly downward and forward from the bridging unit and sleeve 165 at a constant sloping angle of about 5 degrees, and the bottles slide down the tracks 49 to the forward end of the channel 163 to abut the lower cross member and await removal by a customer, as can be seen in FIG. 17. The front end of the rack is similar to the designs of previous embodiments, and the loading and dispensing of bottles is accomplished in the same way. The geometry of the bottles and their retention at the front end of the rack of FIG. 17 is as shown in, e.g., FIG. 12. There is a slight difference in the slope of the channels 161 and 163, but this does not materially affect the loading or dispensing of the bottles at their front ends 167 and 169, where bottles can be easily removed by customers of any height.

Bottles are preferably loaded into the left hand channel members 161, and pushed rearward to fill the channel member 161, after which the rearmost of the bottles passes the apex Z and then slides around and down to the front end of channel member 163. The result is a tendency to push older bottles at the rear of the rack to slide around and be offered to consumers art the front of the second channel member 163, so that bottles are less likely to be kept at the rear of the rack for long periods of time.

The example of FIG. 18 shows a set of ten channel members 161 and 163, forming five respective pairs, but it will be understood that more or fewer channel member pairs may be applied to a rack structure as shown.

It will be understood that the sliding tracks 49 and 199 that slidingly support the bottle necks may be formed of material that is especially low in friction, e.g., HIPS with silicone levels of above 10%, with the material be applied as material different from the remaining structure of the channels 161 and 163 and the bridging structure 151. For example, the sliding structures may take the form of the linear bead of material 131 of FIG. 14 on different material employed for the structure of the channels. Similarly, the tracks 199 may be a separate bead of lower friction material applied on different material used for the structure of the bridging unit 151.

The terms used herein should be read as terms of description rather than of limitation. While embodiments of the invention have here been described, persons skilled in this art will appreciate changes and modifications that may be made to those embodiments without departing from the spirit of the invention, the scope of which is set out in the claims.

What is claimed is:

1. A product display apparatus for displaying a plurality of bottles each having a respective neck with a first width at a first height of the bottle and a wider portion thereabove, said apparatus comprising:

a sliding bottle support structure including left and right slide structures spaced laterally so as to define a slot of substantially uniform width over at least a lengthwise portion of the slide structures, wherein said uniform width is such that the necks of the bottles extend upwardly through the slot and the widened portion rests slidingly on both the slide structures for forward and rearward sliding movement thereon;

wherein the left and right slide structures in said lengthwise portion are inclined forwardly and downwardly at a downward angle relative to level that is in a range of 3 to 7 degrees;

wherein friction between the bottles and the slide structures is low enough that the bottles by virtue of weight thereof slide forwardly on the slide structures; and wherein the display structure includes a stop structure positioned so as to engage a lower part of a forwardmost one of the bottles so that said bottle slides to a position wherein the bottle is against the stop structure and is prevented from further sliding movement beyond said position when additional bottles are supported therebehind on the slide structures; and wherein the slide structures extend linearly forwardly of the stop structure to forward terminal ends positioned at a distance forward of the stop structure such that the forwardmost bottle may be removed from the sliding structures by sliding its neck on the sliding structures to their terminal ends with the bottle tilting forward above the stop structure with the lower part thereof resting against the stop structure.

2. The apparatus of claim 1 wherein the slide structures are straight inclines with a constant downward angle.

3. The apparatus of claim 1 wherein the slide structures are both part of an inclined beam having a pair of side walls each having a respective one of the slide structures supported thereon and projecting inward of the beam therefrom toward the necks of the bottles.

4. The apparatus of claim 3 wherein the beam is a channel-shaped member made up of the side walls, a planar top wall extending between upper ends of the side walls, and flanges extending inward from lower ends of the side walls, the slide structures being on said flanges, and wherein the top wall is joined to the side walls in a curved connecting portion having a radius of curvature of at least 0.15 inches.

5. The apparatus of claim 4, wherein the slide structures are on upwardly extending ridges on inward ends of the flanges, the slide structures being of high-impact polystyrene (HIPS) containing 2% to 10% silicone, and the beam apart from said slide structures being of high-impact polystyrene (HIPS) material containing substantially no silicone, said slide structures being fixedly affixed to the flanges.

6. The apparatus of claim 5, wherein the beam is an extrusion of substantially constant cross section.

7. The apparatus of claim 6, wherein the high-impact polystyrene (HIPS) of the slide structures contains about 10 percent silicone.

8. The apparatus of claim 1, wherein the slide structures are of high-impact polystyrene (HIPS) containing 5 to 11 percent silicone.

9. The apparatus of claim 1, wherein the downward angle is 5 to 6.5 degrees.

10. The apparatus of claim 1, wherein the stop structure is adjustably supported relative to the slide structures so as that the stop structure can be moved to a different height for use of the display apparatus with other bottles of different height than said bottles.

11. The apparatus of claim 1, said terminal ends being positioned relative to the stop structure such that the forwardmost bottle, when tipped forwardly so that the neck thereof is removed from the sliding structures, has a center of gravity vertically above the stop structure, and the bottle can be withdrawn from the apparatus.

12. The apparatus of claim 11, wherein the neck of the bottle is slid to the terminal ends of the slide structures with the lower part thereof resting against the stop structure, the bottle is tilted at about 30 degrees when the bottle clears the stop structure and passes the terminal ends.

13. The apparatus of claim 1, wherein the slide structures are supported on a frame that extends forwardly from a vertically extending support and is detachedly supported thereon.

14. The apparatus of claim 1, wherein the stop structure comprises a laterally extending member supporting thereon a second sliding bottle support structure extending slopingly forward and downward and slidingly supporting widened portion of necks of a further plurality of bottles.

15. The apparatus of claim 1, wherein the sliding bottle support structure is supported on a frame having laterally spaced side arms cantileveredly supported on vertical rear pillars, said stop structure including an armature supported on one of the side arms and a stop member connected with the armature and extending laterally forward of the plurality of bottles, the armature being supported on the side arm so as to provide adjusting vertical movement thereof and of the stop member.

16. The apparatus of claim 15, wherein the side arms are releasably supported on the pillars, said pillars having a plurality of apertures therein, and the side arms being selectably inserted entrappingly in one or more of said apertures so as to select a height of the side arms.

17. A product display apparatus for displaying a plurality of bottles each having a respective neck with a first width at a first height of the bottle and a wider portion thereabove, said apparatus comprising:

a sliding bottle support structure including left and right slide structures spaced from each other so as to define a slot therebetween of substantially uniform width over a sliding bottle travel path of the bottle support structure formed by the slide structures;

wherein said uniform width is such that the bottles are slidingly supported with the necks of the bottles extending upwardly through the slot and the widened portion thereof resting slidingly on the slide structures;

wherein the bottle travel path includes a first substantially straight inclined portion wherein the slide structures extend linearly and slopingly rearwardly and upwardly at a first angle;

a second substantially straight inclined portion wherein the slide structures extend linearly and slopingly rearwardly and upwardly at a second angle that is less steep than the first angle; and an intermediate curved portion connecting a rearward end of the first substantially straight portion and a rearward end of the second substantially straight portion such that the bottles may move slidingly on the slide structures rearward so as to travel through the first substantially straight portion, through the intermediate curved portion, and through the second substantially straight portion so as to be removed from a front end of the second substantially straight portion;

the slide structures in the intermediate curved portion sloping downwardly from the rearward end of the first substantially straight portion to the rearward end of the second substantially straight portion at a third angle;

wherein the first, second and third angles, and a level of friction between the bottles and the slide structures is such that bottles may be pushed slidingly rearward up the first substantially straight portion to an apex in the bottle travel path at a beginning of the intermediate curved portion, and when pushed beyond said apex, said bottles slide by force of gravity through the intermediate curved portion and through the second substantially straight portion to the front end of the second substantially straight portion.

18. The apparatus of claim 17, wherein the sliding bottle support structure comprises a pair of straight channel members connected by a bridging structure, the straight channel members each having a respective pair of inwardly extending lower flange portions extending over substantially the entire length of the channel member, said lower flange portions supporting in the channel member a respective straight portion of the length of the slide structures in the first and second substantially straight portions thereof, and the bridging structure supporting therein a curved portion of the slide structures corresponding to the intermediate curved portion of the bottle travel path.

19. The apparatus of claim 18, wherein the bridging structure comprises a bridging unit having connective sleeves receiving the rearward ends of the channel members such that the portions of the slide structures thereof align operatively with the portion of the slide structures in the bridging unit, said apex being located in the bridging unit.

20. The apparatus of claim 17, wherein the first angle is about 7 degrees, the second angle is about 5 degrees, and the third angle is about 3 degrees.

21. The apparatus of claim 17, wherein the slide structures are of high-impact polystyrene (HIPS) with a silicone content of 2 to 11%.

22. The apparatus of claim 18, wherein the product display apparatus further comprises a plurality of arms supporting therebetween two cross-beams, said cross-beams each connecting and being supported by two or more of said arms, one of said cross-beams being connected with and supporting the first and second channel members, and the other of said cross-beams being connected with the bridging structure.

23. The apparatus of claim 20, wherein the bridging unit has a spacer engaging the cross-beam to the bridging support structure, said spacer setting the third angle at approximately 3 degrees.

24. The apparatus of claim 17, wherein the product display apparatus further comprises a beam or blocking member extending laterally and engaging a lower part of the bottles so as to prevent said bottles from sliding out of the first or second substantially straight inclined portion due to gravity alone.

25. The apparatus of claim 23, wherein the apex of the first straight portion is located in the bridging unit.

26. A product display apparatus for displaying a plurality of bottles each having a respective neck with a first width at a first height of the bottle and a wider portion thereabove, said apparatus comprising:

a sliding bottle support structure including left and right slide structures spaced laterally so as to define a slot of substantially uniform width over at least a lengthwise portion of the slide structures, wherein said uniform width is such that the necks of the bottles extend upwardly through the slot and the widened portion rests slidingly on both the slide structures for forward and rearward sliding movement thereon;

wherein the left and right slide structures in said lengthwise portion are inclined forwardly and downwardly at a downward angle relative to level that is in a range of 3 to 7 degrees;

wherein friction between the bottles and the slide structures is low enough that the bottles by virtue of weight thereof slide forwardly on the slide structures; and a second sliding bottle support structure including left and right slide structures spaced laterally so as to define a slot of substantially uniform width over at least a lengthwise portion of the slide structures, wherein said uniform width is such that the necks of the bottles extend upwardly through the slot and the widened portion rests slidingly on both the slide structures for forward and rearward sliding movement thereon;

wherein the left and right slide structures in said lengthwise portion are inclined forwardly and downwardly at a downward angle less than the downward angle of the first sliding bottle support structure;

the apparatus further comprising a bridging support structure connected with one of the cross members and including a pair of horizontally-spaced curving inclined slide structures of high-impact polystyrene having about 5 to 13% silicone therein, said curving slide structures defining a slot therebetween;

wherein bottles may be moved slidingly on the slide structures so as to travel rearward through the first sliding bottle support structure, through the bridging support structure, and forward through the second sliding bottle support structure so as to be removed from a front end of the second sliding bottle support structure;

the slide structures in the bridging support structure sloping downwardly from a rearward end of the first sliding bottle support structure to a rearward end of the second sliding bottle support structure at a third incline angle of approximately 3 degrees;

wherein the incline angles and friction between the bottles and the slide structures is such that bottles may be pushed slidingly rearward up the sliding bottle support structure to an apex at a beginning of the bridging support structure, and, when pushed beyond said apex, said bottles slide by force of gravity through the bridging support structure and through the second sliding bottle support structure toward a forward end portion of the second sliding bottle support structure from which the bottles may be removed by a user.

27. A display apparatus comprising:

a pair of vertical pillars each supporting a respective upper and lower frame structures;

each frame structure including a pair of laterally spaced side arms each supported on a respective one of the pillars at a height selected from a plurality of vertical positions so that the upper frame is above the lower frame;

each frame further comprising first and second cross members supported on and extending laterally between said side arms;

a first inclined sliding support member supported on the cross members and including a pair of laterally-spaced upwardly-disposed inclined sliding tracks of high-impact polystyrene having about 5 to 13% silicone therein supported on the cross members and extending slopingly forward and downward at an incline angle of approximately 5 to 7 degrees and defining a slot therebetween;

a plurality of bottles supported on the sliding tracks, said bottles each having a neck portion extending through the slot and a neck flange wider than the slot resting slidingly on the tracks with friction between the flange and the sliding tracks being low enough that the weight of each of the bottles causes said bottle to move slidingly forward along the sliding tracks toward a forward terminal end thereof;

the lower frame being at a height such that the first cross member thereof engages a lower portion of a forward-most one of the bottles on the upper frame and prevents forward movement of said bottle to the forward terminal end of the sliding tracks thereof; and a second inclined sliding support member supported on the cross members, said second inclined sliding support member including a pair of laterally-spaced upwardly-disposed inclined sliding tracks of high-impact polystyrene having about 5 to 13% silicone therein and defining a slot therebetween, said second sliding support member being supported on the cross members and extending slopingly forward and downward at an incline angle that is less than the incline angle of the first inclined sliding support member; and a bridging support structure supported on one of the cross members and receiving supportingly therein rear end portions of the first and second sliding support members;

said bridging support structure including a pair of horizontally-spaced curving inclined sliding tracks of high-impact polystyrene having about 5 to 13% silicone therein defining a slot therebetween through which the necks of the bottles can extend and be slidingly retained; and wherein said bottles may be moved slidingly on the sliding tracks rearward so as to travel through the first inclined sliding support member, through the bridging support structure, and through the second inclined sliding support member so as to be removed from a front end of the second inclined sliding support member;

the sliding tracks in the bridging support structure sloping downwardly from the rear end of the first inclined sliding support member to the rear end of the second inclined sliding support member at a third incline angle of approximately 3 degrees;

wherein the incline angles and friction between the bottles and the sliding tracks is such that bottles may be pushed slidingly rearward up the first inclined sliding support member to an apex at a beginning of the bridging support structure, and, when pushed beyond said apex, said bottles slide by force of gravity through the bridging support structure and through the second inclined sliding support member toward the forward end of the second inclined sliding support member where said bottles may be removed from the display apparatus by a user.

28. The apparatus of claim 4 wherein the curved connecting portion has a radius of curvature of about 0.25 inches.

* * * * *